US007140516B2

(12) United States Patent
Bothor et al.

(10) Patent No.: US 7,140,516 B2
(45) Date of Patent: Nov. 28, 2006

(54) DEVICE FOR LARGE-VOLUME CONTAINERS

(76) Inventors: Kerim Patrick Bothor, Alte Dorfstrasse 10 a, DE-22397 Hamburg (DE); Olaf Torge, Kronskamp 8, DE-21255 Tostedt (DE)

( * ) Notice: Subject to any disclaimer, the term of this patent is extended or adjusted under 35 U.S.C. 154(b) by 183 days.

(21) Appl. No.: 10/250,540

(22) PCT Filed: Jan. 7, 2002

(86) PCT No.: PCT/EP02/00060

§ 371 (c)(1),
(2), (4) Date: Nov. 24, 2003

(87) PCT Pub. No.: WO02/053461

PCT Pub. Date: Jul. 11, 2002

(65) Prior Publication Data

US 2004/0074922 A1 Apr. 22, 2004

(30) Foreign Application Priority Data

Jan. 8, 2001 (DE) ..... 201 00 219 U

(51) Int. Cl.

| | |
|---|---|
| ***B67D 5/006*** | (2006.01) |
| ***B65D 25/00*** | (2006.01) |
| *B65B 43/026* | (2006.01) |
| *B66F 9/018* | (2006.01) |

(52) U.S. Cl. ..... 222/185.1; 222/173; 222/143; 222/502; 414/607; 414/608; 53/570; 220/9.4

(58) Field of Classification Search ..... 222/105, 222/612, 180–181.3, 185.1, 173, 608, 143, 222/502, 237; 414/607, 608; 220/9.4, 475, 220/495.06; 53/570

See application file for complete search history.

(56) References Cited

U.S. PATENT DOCUMENTS

| | | | | |
|---|---|---|---|---|
| 2,846,179 | A * | 8/1958 | Monckton | 251/4 |
| 4,527,716 | A * | 7/1985 | Haas et al. | 222/83.5 |
| 4,817,824 | A * | 4/1989 | LaFleur et al. | 222/105 |
| 5,033,706 | A * | 7/1991 | Poulton | 248/149 |
| 5,069,596 | A * | 12/1991 | Mueller et al. | 414/607 |
| 5,322,195 | A | 6/1994 | Ellis | |
| 5,333,757 | A * | 8/1994 | Volk et al. | 222/94 |
| 5,531,360 | A | 7/1996 | Berdel et al. | |
| 5,788,449 | A | 8/1998 | Riemersma | |

(Continued)

FOREIGN PATENT DOCUMENTS

| | | |
|---|---|---|
| DE | 30 02 027 A1 | 7/1981 |

(Continued)

*Primary Examiner*—Gene Mancane
*Assistant Examiner*—Melvin A. Cartagena
(74) *Attorney, Agent, or Firm*—McCormick, Paulding & Huber LLP

(57) ABSTRACT

The invention pertains to an emptying device for large-volume receptacles which consists of an auxiliary transport apparatus that is composed of at least four uprights, on the lower ends of which one respective stacking leg is arranged and in the lower end of which one respective lifting mechanism is arranged. This lifting mechanism can be connected to the carrying straps of the large-volume receptacle by means of carrying strap holders, wherein the uprights are respectively connected to one another by means of transverse braces in their lower region in order to accommodate a bottom plate. The bottom plate contains a central opening for accommodating a shutter mechanism with a shutter that is situated in a base plate arranged on the bottom plate and can be actuated by means of a hand crank.

21 Claims, 7 Drawing Sheets

U.S. PATENT DOCUMENTS 6,105,804 A * 8/2000 Stoffer ..... 220/9.4
6,138,443 A * 10/2000 Taylor et al. ..... 53/492
6,318,594 B1 * 11/2001 Hutchins ..... 222/1

FOREIGN PATENT DOCUMENTS

DE G94 07 507 U1 10/1994
DE 296 02 294 U1 5/1996
DE 197 41 108 A1 3/1999
EP 0 373 506 A1 6/1990
EP 0 827 916 A1 3/1998
FR 2 633 593 1/1990
FR 2 643 887 9/1990
FR 2 644 135 9/1990
GB 2 014 965 A 9/1979
GB 2 066 220 A 7/1981

* cited by examiner

DEVICE FOR LARGE-VOLUME CONTAINERS

BACKGROUND OF THE INVENTION

1. Technical Field

The invention pertains to a device for emptying, filling, storing and transporting large-volume receptacles of all types.

2. Background Information

Bulk materials are increasingly packaged into large-volume receptacles (>1 $m^3$) that are referred to as Big Bags below, namely in weights that, depending on the density of the bulk material, lie between a few hundred kilograms and a few tons.

Stationary systems for emptying large-volume receptacles are known. The filling, emptying, transporting and storing of such large-volume receptacles, e.g., a Big Bag or a container, is quite problematic because the large volume and high weight of such receptacles makes them very difficult to handle. Receptacles of this type require very complex systems that are not only difficult to operate, but also require a very costly storage and transport. These systems which essentially consist of filling and emptying stations are generally realized in the form of stationary units, into which the large-volume receptacle, in particular a Big Bag, needs to be placed. For example, if an unloading station is not available, large-volume receptacles, in particular Big Bags, can also be emptied on an industrial scale with the aid of suction devices or by destroying the receptacle, i.e., by cutting open the bottom of the large-volume receptacle. Once the bottom of the large-volume receptacle is cut open, the receptacle, in particular a Big Bag, can no longer be used. Full large-volume receptacles are usually stored directly on the floor of a storage area or with the aid of pallets, wherein receptacles are sometimes also stored by stacking them on top of one another in the shape of a pyramid in a storage area. The storage in high bay racking systems is only possible under certain conditions.

Emptying devices are known from the state of the art. For example, GB-PS 2 014 965 discloses an emptying device for large-volume receptacles which consists of a frame, in which the large-volume receptacle to be emptied, in particular a Big Bag, can be suspended. The lower end of the large-volume receptacle to be suspended in said frame is provided with a funnel-shaped outlet. However, this device is merely suitable for a very specific type of large-volume receptacle, namely for cylindrical "Big Bags." The disadvantage of this device can be seen in the fact that the large-volume receptacle can only be suspended in the device with a substantial expenditure, and that a metered emptying cannot be realized with this emptying device because it does not contain a shutter for controlling the emptying of the large-volume receptacle in a metered fashion. Another disadvantage is that this emptying device can only be stored and transported with great difficulties.

GB-PS 2 066 220 discloses an emptying device for large-volume receptacles which consists of a mount that is provided with four legs arranged on the corners of the mount, as well as a base plate. In this case, two of the four legs are upwardly extended by means of uprights that are realized in the shape of a gallows. The large-volume receptacle to be emptied, preferably a Big Bag, can be suspended on the short protruding braces. In addition, a central opening with a hatch is arranged in the base plate. However, this hatch does not make it possible to realize a metered and clean emptying of the large-volume receptacle, in particular a Big Bag, namely because the seal required for achieving a clean emptying process is not provided. It is also disadvantageous that this emptying device is difficult to handle and store, in particular, because these emptying devices cannot be stored on top of one another due to the mount for suspending the large-volume receptacle. In addition, a complete emptying of the large-volume receptacle cannot be realized with this device.

DE OS 197 41 108 discloses a device for emptying pourable bulk material, wherein the emptying is realized by means of a suction device, e.g., a suction pipe, a suction head or the like. This device consists of a collapsible frame for suspending the large-volume receptacles which comprises a lifting device for stretching the large-volume receptacles. This lifting device consists of a cable pull and deflection rollers that are respectively arranged on the upper ends of the four uprights or posts that are situated on the corners and over which the lifting cables for the large-volume receptacle are guided. In this case, it is disadvantageous that the lifting device used is only suitable for large-volume receptacles up to a certain weight and consequently cannot be universally utilized for any type of large-volume receptacle. In addition, this emptying device does not contain a shutter for realizing a metered or controlled emptying process.

GbM 94 07 507.7 discloses an emptying device that simultaneously represents a large-volume receptacle for pourable masses and consists of a receptacle mount with a bottom plate and a side wall that serves for supporting the bag and is realized in a telescopic fashion. The upper end of this device is also provided with a connecting device for a lifting device, to which a strap can be connected in such a way that the large-volume receptacle, e.g., a Big Bag, can be lowered downward during the emptying process. This means that the receptacle is emptied downward and the large-volume receptacle can be pulled upward during the filling process such that the large-volume receptacle can be filled with the respective bulk material from the bottom. For this purpose, an opening is provided in the lower region, wherein this opening is connected to a line, through which the large-volume receptacle can be filled. In this case, it is disadvantageous that neither a metered emptying of the large-volume receptacle nor a metered filling thereof can be achieved with this device because it does not contain a controllable shutter for controlling the emptying or filling process.

DE-OS 199 45 195 discloses an emptying device for large bags that comprises two essentially flat, preferably identical side elements that respectively form a front and a rear bottom region and at least one top region, wherein said side elements contain a vertically operating lifting device with connecting zones for lateral connecting elements, and wherein the side elements have a height that is greater than the height of a large-volume receptacle to be suspended. A lifting crosshead can be separably arranged between the lifting devices, wherein said crosshead contains holding means for the suspension straps, as well as at least one transverse connecting means for a transverse brace. In this case, it is disadvantageous that a metered emptying of the large-volume receptacles cannot be realized with this device because this device also does not contain a controllable shutter for allowing a clean and controlled gradual emptying of the large-volume receptacle. Another disadvantage can be seen in the fact that the transport and storage of this device are associated with very high expenditures.

DISCLOSURE OF THE INVENTION

The invention is based on the objective of developing a device of the initially described type for large-volume receptacles which makes it possible to realize a controllable emptying and filling of the receptacles and can be transported and stored in a comparatively simple fashion, wherein said device is inexpensive and can be used for all commercial large-volume receptacles, in particular Big Bags.

This objective is attained with a device for large-volume receptacles which serves for accommodating, transporting, storing and emptying in a controlled fashion pourable products situated in flexible large-volume receptacles, e.g. Big Bags, FIBC (Flexible Intermediate Container), characterized in that the device for large-volume receptacles contains an auxiliary transport means for accommodating a large-volume receptacle, that the transport means has uprights which are realized in the form of hollow members for accomodating lifting mechanisms which are arranged in the upper ends of the uprights, that one respective stacking leg is arranged on the lower ends of the uprights and that the device for large-volume receptacles contains a shutter mechanism for emptying the large-volume receptacle in a metered fashion.

The invention proposes that the emptying device for large-volume receptacles consists of an auxiliary transport means that is composed of a frame with four stacking legs that are respectively connected to one another with batten-like transverse braces such that they are approximately arranged in a quadriform fashion and rigidly connected to four uprights that are realized in the form of hollow members in order to accommodate an integrated lifting mechanism that promotes the emptying of the large-volume receptacle and ensures the complete emptying thereof. The invention also proposes that the auxiliary transport means in the form of a frame is provided with a bottom plate that contains a central opening for receiving a metering and shutter mechanism, wherein the metering and shutter mechanism consists of a base plate that is connected to the bottom plate and serves for accommodating the shutter. The bottom plate may be realized in the form of a solid element or a palette. In addition, the bottom plate may be realized continuously or only sectionally, i.e., in a batten-like fashion such that the weight is reduced by a certain amount and the transport of the device for large-volume receptacles is simplified.

The shutter mechanism is designed in such a way that the inlet connector as well as the outlet connector of the large-volume receptacle can be easily inserted into the shutter. The shutter is constructed such that at least two cables, bands, belts or chains are concentrically placed around the outlet that also consists of a flexible material and is usually situated centrally on the underside of the large-volume receptacle, wherein said cables, bands, belts or chains continuously reduce or enlarge the outlet diameter. On one end, the at least two cables are symmetrically and oppositely arranged on a rotatable ring in a freely movable fashion, wherein embodiments with a larger number of cables would alternatively also be conceivable. The other end of each cable is realized in such a way that a lengthening and shortening can be realized. This can be achieved directly, for example, by utilizing suitable tension mechanisms such as tension springs or pneumatic tension springs or, if correspondingly designed pressure mechanisms are provided, indirectly by means of pressure, pneumatic pressure springs or the like. Instead of the combination consisting of a cable and a tension spring which is illustrated in figure, it would, for example, also be conceivable to utilize a rubber band of limited expansion. The tension and pressure mechanisms are suitably connected to the housing of the shutter. A stopping device incorporated into the cable construction prevents the tension mechanisms from becoming overstretched and tightens the corresponding cables.

Instead of cables, it would also be conceivable to utilize rods or flexible rods of carbon fibers, synthetic fibers, metal fibers or glass fibers which are fixed rotatably, but not displaceably on the rotatable ring with one end. In this case, the ring is provided with openings, through which the ends of the rods fixed at this location can be pushed, such that the rods are supported in a displaceable fashion. A spring can be pushed onto the end of the rods, wherein said spring is connected to a stopper fixed on the outer end of the rods such that the rods can be bent and placed around the outlet connector. The outlet cross section can be reduced when the outlet connector is closed and enlarged again when the outlet connector is opened by bending the rods accordingly. The invention proposes that several pins are arranged on the outer edge of the base plate of the shutter mechanism, wherein the upper region of said pins is provided with a circular, cylindrical or square opening, through which the free end of the rods can be pushed such that they are displaceably supported in the pins. In this case, the end protrudes over the pin such that a spring can be pushed onto the end which is connected to a stopper that is arranged on the other end of the rods and limits the mobility thereof. The rods may also consist of flexible rods with a wire core and a plastic casing.

The rotatable ring is realized in such a way that it can be indirectly or directly driven with the aid of a suitable drive. An indirect drive may, for example, be realized by providing the ring with a correspondingly toothing that meshes with the drive toothing of another toothed wheel. Alternatively, the drive may, for example, also be realized with the aid of a cable, a band or chain blocks. If the drive is realized with chain blocks, chain or belt gears are utilized in which the power transmission between the chain wheel and the chain takes place in the form of a positive engagement, a positive engagement with superimposed frictional engagement or a frictional engagement exclusively. In this case, the transmission ratio depends on the diameter and the gear ratio of the chain wheels. The chain may be realized in the form of a driving chain, a bush chain, a roller chain, a ladder chain, a non-positive roller chain, a round steel chain, a sprocket chain, a load chain or a transport chain. As an alternative to chains, it would also be conceivable to utilize belt gears with a pulley and an endless belt. The belt gear is suitable for low and average torques and speeds, serves for compensating large axial distances within broad tolerances, as well as for protecting the device from an overload due to sliding, and ensures an extremely calm and quiet operation. A chain gear, in contrast, is suitable for the transmission of average torques and serves for compensating average axial distances within broad tolerances, wherein a chain gear also represents an inexpensive, well accessible and robust system. The belt may either consist of a single-layer fabric belt, a multi-layer fabric belt, a polyester cord belt or a band-type belt with broad tension bands. In this case, the belt is composed of an upper layer or cover layer, a central layer, the tension layer and a bottom layer or contact layer. The tension layer may comprise one or more layers, wherein it is common practice to provide two, three or more layers that may also have different structures. These layers usually consist of polyamide, polyamide in combination with cotton, polyester or a combination of cotton, polyamide and polyester. The layers usually have a rod-shaped structure, wherein a honeycomb or segmented structure would also be conceivable. The contact layers usually consist of an elastomer, polyurethane, balata or chrome leather. It would also be possible to utilize synchronous belts or toothed belts, the belt bodies of which consist of neoprene or polyurethane with embedded tension rods of high-strength glass fibers or steel, Kevlar or polyester cords that are helically wound in most endless belts manufactured in a standard lengths. The belts may contain a single or double toothing, wherein the teeth may have a square, rectangular, semicircular, trapezoidal, triangular or polygonal shape. It would also be conceivable to utilize a hydraulic drive instead of a toothed wheel gear.

The optional drives described above are moved by means of a selflocking or non-selflocking worm gear. The worm gear is driven manually, electrically, pneumatically or hydraulically. In a direct drive, a toothing arranged on the outside diameter of the rotatable ring makes it possible to realize a direct drive via a selflocking worm gear that directly engages into the toothing of the rotatable ring, is coupled with manual, electric, pneumatic or hydraulic drives and may comprise an overload safety for the forces transmitted from the drives.

Alternatively, the shutter drive may also be realized with the aid of a revolving chain that is connected to a motor or the like. For this purpose, a large number of rotatable pins are arranged on the outer region of the base plate, wherein said pins also serve for deflecting the chain and are connected to the rotatable ring via cables, chains, belts, bands, rods, wires or the like in order to actuate said ring.

The invention also proposes that a lifting mechanism is arranged in the upper region of each upright or of each post or of each post of the tubular frame, wherein said lifting mechanism is either integrated into each upright or post or fixed thereon. In the latter instance, the lifting mechanism is either directly fixed on the outer side of the uprights or posts or indirectly by means of an additional short pipe that is arranged on the outer side of each upright and serves for accommodating the lifting mechanism. The lifting mechanism is usually realized in the form of a pneumatic pressure spring, but may also consist of a hydraulic piston, a spring, a cable pull or a chain block that may be actuated electrically, pneumatically, hydraulically or manually. The large-volume receptacle is suspended between the uprights or posts and suitably connected to the lifting mechanism by means of a self-tightening carrying strap holder. When using flexible receptacles that are usually equipped with carrying straps, this is realized by suspending the respective straps on the corresponding lifting mechanisms. The lifting mechanisms are in the retracted state when the receptacle is filled and until the filling level or residual weight of the bulk material in the large-volume receptacle required for triggering the lifting mechanism is reached. Once the bulk material situated in the large-volume receptacle has been emptied to the required degree, the decrease in the weight of the large-volume receptacle causes the lifting mechanisms to be triggered such that they raise the large-volume receptacle. In this case, the lift is automatically adjusted proportionally to the removed quantity of bulk material, wherein the bottom of the large-volume receptacle assumes the shape of a conical funnel when the lifting mechanisms are completely extended. This makes it possible to ensure that free-flowing bulk material can be removed from the large-volume receptacle in its entirety.

The invention also proposes that a self-tightening carrying strap holder is provided for suspending a filled bag in the lifting device. These holders make it possible to directly suspend the respective straps of a filled large-volume receptacle in the lifting device. The carrying straps of the large-volume receptacles can be suspended in the self-tightening carrying strap holders by respectively fixing a holder on the lower end of the carrying strap, i.e., in the vicinity of the large-volume receptacle, when a loaded large-volume receptacle is conventionally suspended on its carrying straps. In this case, the respective carrying straps can be connected to a transport or lifting means and utilized for the load suspension. The upper segment or loop remains freely movable and is used for producing the connection with the lifting mechanism of the palette. The respective carrying straps of the large-volume receptacles are suspended in the corresponding holders by pivoting upward the rotatable bolt that can also be displaced downward and upward, i.e., the bolt is pivoted out of the holding region of the holder. The carrying strap that is folded into a loop is pushed through the opening of the holder, and the bolt is pivoted into the holder and pushed against the limit stop. The bolt tightly adjoins the lower limit stop of the holder when pulling on the thusly formed loop and consequently pulls on the end of the carrying strap which is connected to the large-volume receptacle such that the carrying strap is tightened. The upper end of the carrying strap holder is suitably connected to the lifting means, e.g., a cruciform load carrying element. The carrying strap is held in the carrying strap holder in a self-secured fashion under the influence of the forces acting in opposite directions, i.e., the weight of the large-volume receptacle which represents a downwardly acting force and the force of the lifting means which represents an upwardly acting force. The free end of the carrying strap can now be engaged with the lifting device and the filled large-volume receptacle can be lowered into the device. The bolt is laterally pulled out in order to disengage the connection between the large-volume receptacle and the lifting device which is under tension due to the carrying strap. The tension of the carrying strap is then completely alleviated and the carrying strap holder is released.

In this respect, the carrying strap arrangement of the flexible large-volume receptacle used may also be realized or modified such that, when utilizing a filled receptacle that is normally suspended on its carrying straps, one additional carrying strap is respectively provided on each corner of the flexible large-volume receptacle. If only one strap is provided in each corner, this strap is divided into two strap segments by centrally knotting the strap such that the upper strap segment is freely movable and can be used for producing the connection with the lifting mechanism of the palette.

Instead of a bolt, the carrying strap holder may also contain a plate in the form of a clamping element, a clamp or the like.

It would also be conceivable that the auxiliary transport means consists of a box, the bottom of which is realized in the form of a palette with a centrally arranged opening for accommodating the shutter mechanism. In this case, the walls of the box may either be realized solidly or sectionally. Posts that serve for connecting the walls and for reinforcing the box are arranged in the corners of the box. These posts are realized in the form of solid or hollow members such that a lifting device can be respectively arranged in their upper ends, wherein the upper region of solid posts contains cavities for receiving the lifting device. The corners can be additionally reinforced with plate-like backing fabrics that are diagonally arranged in front of the posts on the inner side of the box. The walls may consist of wood, recycled boards, plastic, metal, carbon fibers or glass fibers. Alternatively, the walls may also consist of several wood layers and recycled board layers that are respectively glued to one another, wherein this type of plate may contain a core that either consists of wood or a plastic and is surrounded by cover layers of metal. The walls may also contain a polyurethane core that this provided with an outer layer reinforced with carbon fibers or glass fibers. The walls may be selectively realized in the form of solid elements or hollow elements, wherein the walls have a batten-shaped or rod-shaped design if they are realized sectionally. The battens or rods may either be arranged transversely, perpendicularly or diagonally. Alternatively, the walls may be realized in a rod-shaped, blade-like or even screen-like fashion. Screen-like walls may also be provided with a pattern formed by alternately arranging openings and wall sections. In this case, the wall sections may have many different shapes such that numerous different patterns can be realized. For example, half moon-shaped patterns, screen-like patterns, column-like patterns, rod-like patterns, snowflake-like patterns, bell-like patterns and other types of patterns can be realized.

The bottom plate may either be realized solidly or sectionally, wherein the bottom plate may have a batten-shaped, grate-shaped, screen-shaped, blade-shaped, web-shaped or honeycomb-shaped design. Alternatively, the bottom plate may also have an X structure, a double-X structure, a Y structure or a double-Y structure.

Alternatively, the auxiliary transport means may also consist of a bottom plate that is realized in the form of a stacking palette or a Europalette, in the corners of which respective openings for receiving uprights or posts are arranged. These uprights or posts are provided with stilts or stacking legs on their lower ends, wherein the stilts or stacking legs may also be realized such that the can be directly fixed on the bottom plate, e.g., by means of screws or the like.

The auxiliary transport means may also be realized in the form of a holding frame with integrated or attached holding mechanisms in order to promote the emptying process and to ensure a complete emptying of the respective receptacle by shaping the bottom of the large-volume receptacle in a conical fashion, wherein the lifting mechanisms are only triggered once the free-flowing bulk material situated in the receptacle has been emptied to a certain degree. In this case, the holding frame may consist of suitable frames, tubular frames or posts that are arranged on the bottom plate realized in the form of a palette. A lifting mechanism is attached to or integrated into the upper region of each upright or of each post or of each post of the tubular frame. The flexible receptacle is suspended between the posts and suitably connected to each lifting mechanism. The design of the posts also makes it possible to stack several palettes on top of one another if the Big Bags are filled or partially filled. In addition, the pallets themselves can also be stacked by pulling out, folding or pivoting the posts or the frame, respectively.

Another advantage of this device for large-volume receptacles is that a significant reduction in the required handling and system expenditures is achieved. In addition, the time required for handling the large-volume receptacles is significantly reduced. The invention also makes it possible to transport the emptying device into and out of a filling station for large-volume receptacles of all types in a partially automated or fully automated fashion with the aid of automatic palette conveyor systems. Consequently, large-volume receptacles of any type can be emptied or filled with this emptying device. The invention allows the automatic docking of a filling connector of a filling device, as well as the storage of filled and partially emptied large-volume receptacles, in particular Big Bags, in high bay racking systems. A significantly lowered empty volume is achieved in instances in which the device is intermediately stored or handled without containing a receptacle. The utilization and the design of the carrying straps and the self-tightening holders makes it possible to utilize the device with already filled large-volume receptacles.

The device according to the invention can be utilized as a system for transporting, storing, filling, partially emptying and completely emptying large-volume receptacles. The device significantly simplifies the system expenditures and the expenditure of labor due to the fact that the large-volume receptacle, in particular a Big Bag, remains in the device over its entire life cycle and can be handled by means of conventional transport and handling devices that are already provided anyhow in numerous facilities, e.g., a forklift. The device can also be utilized for automating the loading and unloading systems for large-volume receptacles. The device according to the invention provides a cost-efficient alternative to conventional handling devices available on the market. The metering and shutter mechanism integrated into the device makes it possible to empty the contents of the receptacle in a controlled fashion. The shutter mechanism had to be especially developed for the utilization in a palette so as to ensure that the palette can still be handled with conventional transport devices. The metering and shutter mechanism is characterized by its simple design, a low structural height and minimized outside dimensions. The metering and shutter mechanism does not impair the customary utilization options of a palette in any way. The metering and shutter mechanism is actuated manually with the aid of a hand crank, a hand wheel or via electric, electromagnetic, hydraulic or pneumatic drives. In case of a stationary unloading station, the drive shaft of the shutter is realized in such a way that an electric, electromagnetic, hydraulic or pneumatic drive can be automatically docked thereto, wherein the emptying process may be controlled manually or automatically.

The product situated in the receptacle can be emptied in a controlled fashion with the aid of the integrated metering mechanism after the device is placed onto a simple platform at any suitable location. The incorporation into bulk material conveyor systems is ensured due to the utilization of conventional docking stations for the outlet connectors of the large-volume receptacles which protrude through the device. The invention allows the utilization of large-volume receptacles by users who were thus far unable to do so due to the high investment costs for the required systems or the space requirement. In other words, the invention broadens the potential for the utilization of large-volume receptacles. The storage and intermediate storage of filled and, in particular, partially emptied large-volume receptacles in storage systems such as, for example, high bay racking systems is now possible since the textile receptacle material cannot collapse or hang over the device. This is achieved due to the fact that the large-volume receptacle is always suspended between the uprights in a stretched state. The space requirement for storing and transporting units currently not being used is significantly reduced because removable rigid or collapsible uprights are provided and the device is designed for being stacked. It can be assumed that a large-volume receptacle placed into an unloading station remains therein until it is completely emptied, and that facilities, in which several products delivered in flexible receptacles are processed, contain a corresponding number of unloading stations. The device merely requires a simple platform, onto which it is placed. The simplified design of the unloading station significantly increases its flexibility, namely because the partial emptying of a large-volume receptacles can be achieved much faster and with a significantly reduced handling expenditure. After undocking the outlet connector, a transport device, e.g., a forklift, suffices for removing the device from the platform and for placing a new device thereon.

Conventional automated palette transport and handling systems can be utilized since the large-volume receptacle stands on the bottom plate realized in the form of a palette and is suspended in the device on its carrying straps. These processes can be partially automated or fully automated by transporting the device into loading and unloading stations in an automated fashion and by automatically docking the filling connector of the filling station. Time-consuming manual activities which were required thus far for the conventional handling of large-volume receptacles are also eliminated such that much time is saved. Until now, a large-volume receptacle was either transported to the unloading station on a palette that had to be placed underneath the large-volume receptacle in a separate step or on a cruciform load carrying element that, for example, was arranged on a forklift and on which the large-volume receptacle had to be manually suspended with typically four carrying straps. Subsequently, the large-volume receptacle had to be manually suspended on the lifting device of the unloading station. The lifting device usually was also manually actuated in a time-consuming fashion. The device according to the invention, in contrast, merely requires the utilization of, for example, a forklift in order to transport the device from its storage area to the unloading station. The loading of filled large-volume receptacles and their exchange for use in the same device can be carried out much easier and faster. The exchange of filled large-volume receptacles is simplified due to the design of the carrying straps and, in particular, the self-tightening holders. The problems in placing partially filled or filled large-volume receptacles into the device can be seen in that the same carrying strap is also used for the suspension in the lifting device. Assuming the large-volume receptacle is suspended on the hooks of a cruciform load carrying element, the receptacle of the lifting mechanism can only be placed into the same carrying strap underneath the hook of the load carrying element. When lowering the large-volume of receptacle into the device, the lifting mechanisms are subjected to pressure such that the hook of the load carrying element is clamped in the carrying strap by the receptacle for the lifting mechanism when the large-volume receptacle is placed into the device. The hook of the load carrying element can only be removed with great difficulties. If the large-volume receptacle is realized with 2 carrying straps in each corner or each carrying strap is centrally knotted into two segments or the self-tightening carrying strap holders are utilized, one strap or one strap segment always remains freely movable because it is not subjected to a load.

The bottom plate realized in the form of a palette may be modified in such a way that it contains suitable receptacles for conventional transport and handling devices on all sides, e.g., for forklifts, automatic palette stacking and destacking systems, stacker lift trucks, etc. This means that the handling of the palette is not limited in any way.

In a second embodiment of the device for large-volume receptacles, the device is realized in the form of a collapsible stacking palette. In this case, the auxiliary transport means consists of a frame that can be collapsed by pivoting the uprights inward such that a low stacking height is achieved. In this case, the lower ends of the uprights are provided with bolt-type locks for adjusting and fixing the uprights on the bottom plate or bottom frame such that their position cannot be changed. The device consists of a collapsible stacking palette, in which large-volume receptacles of all types can be suspended, wherein this palette is suitable for dumping large-volume receptacles through an opening by means of rotary forklifts, in which the prongs of the forklift are rotatable. Due to this construction, the device has a reduced height in the collapsed state, as well as in the operative state, in which a large-volume receptacle is suspended in the device. In addition, a high load bearing ability for several palettes with filled large-volume receptacles which are stacked on top of one another is achieved.

The device for large-volume receptacles in the form of a collapsible stacking palette consists of a base that forms the bottom and consists of four stacking legs that are realized in a plate-like fashion on their underside. In this case, two stacking legs are respectively connected to one another with crossheads that are connected to two box-like, batten-like or tubular crossbeams for reinforcement purposes. The crossbeams usually consist of steel or aluminum, but can alternatively be made of wood as it may also be the case with the entire construction. This results in a batten-like base. Side walls that respectively consist of two posts that are connected to the stacking legs in an articulated fashion are respectively connected to the stacking legs. Two hinged walls are arranged in an articulated fashion on the crossheads of the base such that they can be pivoted inward and lie underneath or above the connecting beams. In this case, the hinged walls do not lie on top of one another such that they do not unnecessarily increase the height of the device, wherein the pivoting radius of the hinged walls does not exceed half the palette width. The hinged walls consist of two essentially rectangular walls that are either realized continuously over the entire hinged wall or only sectionally. On their upper ends, the hinged walls are rigidly connected to an additional box-shaped profile strip that extends over the entire width of the hinged wall. The side walls can be pivoted inward over the hinged walls, wherein the posts of the side walls are pivoted inward into the same plane as the hinged walls such that they lie above the connecting beam. The respective hinged walls are also provided with at least one connecting element for producing a connection between the hinged walls, wherein said connecting elements take up the forces occurring during the tilting process and transmit said forces in all three directions such that the palette is prevented from collapsing or unfolding. The connecting element may be realized in the form of a bolt, a plug-type connector, a magnet, a quarter-turn fastener, a bayonet connector or a lock with a latch. Alternatively, the connection can be produced the means of clamps or screws. The hinged walls additionally contain mounting arms that are offset in such a way that the posts of the side walls directly lie on the connecting beam, wherein the mounting arm is offset underneath the posts of the side walls such that the stacking height of the collapsed palette is smaller than or equal to the sum of the thickness of the connecting beam and the thickness of the side wall posts. The crossheads of the base which extend between the posts of the side walls are respectively provided with elevations on their ends in order to prevent a palette lying on top thereof from sliding. This allows a safe and reliable stacking of the device for large-volume receptacles. The respective posts of the side walls are provided with suspension/stacking heads on their upper ends, wherein said heads can be inserted into the recess of the plate-like stacking legs and additionally serve for suspending the straps of large-volume receptacles. These heads contain an essentially trapezoidal cutout that also may have a circular, rectangular, square, hexagonal, octagonal or polygonal shape. Alternatively, the suspension/stacking heads contain one or more hooks that is/are arranged such that the straps of the large bag are not pinched or sheared off by the stacking legs of a second palette placed on top thereof. This is achieved due to the fact that the cutout is arranged at a sufficient distance from the outer edge of the stacking head. This device is suitable for suspending large-volume receptacles with at least four or more carrying straps such that the large-volume receptacles suspended thereon can be dumped toward at least two sides while being fixed such that they cannot fall out. This is achieved due to the fact that the large-volume receptacle is fixed on the suspension/stacking hands with its straps during the tilting process and at least two cutouts or hooks for fixing the lower straps of the large-volume receptacle are situated on the base such that the large-volume receptacle also remains fixed under the influence of the load if it is turned in excess of 180°. The beams for connecting the crossheads of the frame to one another may be realized in the form of hollow members such that the prongs of the forklift can be easily inserted therein. In this case, the beams are realized in a rectangular, round, polygonal, octagonal or polygonal fashion. The profile strips can also be realized in the form of cruciform strips such that the prongs of the forklift can be inserted therein from all sides. Alternatively, pipes or box-shaped strips, into which the prongs of a forklift can be inserted, may be arranged on the undersides of the beams. In this case, the beams are realized in the form of solid members. The holding frame or the tubular frame is realized in such a way that joints or hinges arranged at corresponding locations make it possible to collapse the frame, namely such that the size of the collapsed frame does not exceed the edge length of the palette. The holding frame is also realized in such a way that an empty Big Bag which is still suspended in the frame can be accommodated between the collapsed frame.

Each post is realized in such a way that empty palettes can be stacked on top of one another while the holding frame is collapsed. In addition, several palettes with filled or partially filled Big Bags can be stacked on top of one another.

In a third embodiment of the device for large-volume receptacles, at least four articulated arms are provided, wherein the lower ends of said arms are connected in an articulated fashion to the base plate of the shutter mechanism arranged on the bottom plate. On their outer or upper ends, the arms respectively contain a device for connecting the articulated arms to the four lower straps of the large-volume receptacle such that the four articulated arms promote the formation of a funnel which occurs during the emptying of the large-volume receptacle under the assistance of the lifting device. During the emptying of the large-volume receptacle, these arms are pivoted upward such that the bottom of the large-volume receptacle can be supported thereon. The articulated arms are interconnected by a central joint that contains a central gear as the driving mechanism, wherein the central gear may consist of a toothed wheel gear, a chain gear, a rod assembly, a belt gear or a hydraulic gear. Alternatively, it would also be possible to provide the outer ends of the articulated arms with rollers. In this case, the uprights are realized in the form of rails, and the opening of the rails is directed inward such that the rollers arranged on the upper ends of the articulated arms are able to engage into the rails and the arms can be pivoted upward while the rollers are engaged in the rails. The rails may be selectively realized in the shape of a U, V, C or H. The arms may also be designed telescopically, wherein the arms consist of several individual segments that can be pushed into one another in order to adjust the length of the arms. The individual segments can be fixed in position with a certain number of round, square or polygonal openings, into which holding and fixing means in the form of pins or clamps are inserted.

Instead of providing the above-mentioned articulated arms, it would also be possible to realize the bottom plate itself in an articulated fashion. In this case, the bottom plate is provided with a central continuous joint or hinge such that the bottom plate is divided into at least two segments that can be pivoted upward on the outer sides. One or more rollers may be arranged on the outer corners such that they are able to engage into uprights realized in the form of rails. This arrangement may also consist of an attachment that can be placed onto the bottom plate realized in the form of a palette, wherein the attachment consists of segments and can be connected to said palette.

The bottom plate may also consist of individual segments of different shapes which are connected to one another in an articulated fashion such that a bottom plate of arbitrary shape can be formed in order to promote the funnel formation. In this case, the bottom plate can be raised at different locations in order to promote the emptying of large-volume receptacles.

In a fourth embodiment, the device for large-volume receptacles is provided with a template-like attachment that can be separably connected to the bottom plate by means of bolts, plug-type connectors, locks or the like and is either realized in the form of a frame, a plate or a box that is open on its upper side. In this case, the plate is provided with walls on all four sides, wherein said walls are fixed in pairs to the upper or lower side of the plate such that the plate is able to selectively function as a bottom or as a cover of the attachment. The attachment may have different heights, and the plate is realized in the form of a frame such that it is also suitable for accommodating container-like large-volume receptacles. In this case, it is possible to exchange this frame-like plate for another frame-like plate with a shape that is adapted to the shape and size of the large-volume receptacle and significantly simplifies the insertion of the outlet connector of the large-volume receptacle into the shutter system. This makes it possible to utilize the emptying device for all shapes of large-volume receptacles. The attachment may either consist of metal, plastic or wood and contain walls of varying thickness. Each edge of the plate realized in the form of a frame usually has an angular shape, i.e., the square or rectangular shape. However, the edges may also have any other shape. Alternatively, the attachment may be realized telescopically, wherein the attachment is composed of wall sections that can be telescopically pulled apart and pushed into one another such that their height can be adjusted.

According to a fifth embodiment, the stacking legs of the device for large-volume receptacles are realized exchangeably, namely such that they can be exchanged for supports of arbitrary length which are arranged on the undersides of the uprights in a separable fashion. This makes it possible to adjust a sufficient space from the ground underneath the shutter for pushing a wheelbarrow or the like underneath the device for large-volume receptacles in order to receive the bulk material contained in the large-volume receptacle. These extendable legs or stilts are connected to the frame or the bottom plate of the device for large-volume receptacles by means of a lockable connection such that they can be adjusted to any arbitrary height. For example, this makes it possible to push a pedestal underneath the device for large-volume receptacles and to connect this pedestal to the underside of the shutter that, for example, contains a worm for accelerating the emptying of the large-volume receptacle. This also makes it possible to refill the bulk material, for example, into smaller receptacles. This embodiment provides a versatile device for large-volume receptacles which can be used in connection with any devices for emptying large-volume receptacles. This embodiment also allows a modular design of the device for large-volume receptacles such that it can either be attached to other modules and separably connected thereto or integrated therein. This modular structure is realized in the form of a frame that guides and accommodates the bottom plate of the device, wherein the opening of the bottom plate and the outlet opening are aligned with a correspondingly realized shaft with a conveying device, e.g., a worm, such that a rapid emptying of the receptacle can be achieved.

According to a sixth embodiment, the shutter of the emptying device can be connected to a hose or a pipe, through which an emptied large-volume receptacle can be refilled with bulk material or similar free-flowing, dustlike, powdery, grained or granular products. These products are blown or otherwise introduced through a line connected to the shutter. This makes it necessary to realize a ventilation in the upper region. For this purpose, the device for large-volume receptacles needs to be covered with a cover plate that can be connected to the upper ends of the uprights and placed onto the lifting devices, wherein the cover plate contains a central opening for realizing the ventilation, e.g., by connecting another hose, the other end of which can be connected to a vacuum pump or the like. A rubber collar, a collar of a cellular material or a styrofoam collar is arranged in this opening for sealing purposes.

The cover plate may also contain an opening, in which a shutter mechanism is fixed which consists of a metering shutter that is arranged in the base plate and onto which the cover plate that may have the shape of a roof, a truncated cone or a pyramid is placed. This opening is realized such that a hose or a pipe can be connected thereto.

Alternatively, the shutter may also consist of a harness, e.g., of chains or belts that serve for fixing the shutter on the suspension/stacking heads arranged on the upper ends of the uprights.

Alternatively, it would be possible for a suction hose that is connected to a suction device in the form of a floating suction head or a suction pipe to extend through the centrally arranged opening in the cover plate in order to fill or empty the receptacle, wherein the product can be removed from the container by suction or blown into the container from the top. In this case, the outlet connector on the bottom of the large-volume receptacle is closed by means of the shutter such that the emptying or filling takes place from the top.

According to a seventh embodiment, the shutter for realizing a metered emptying of the large-volume receptacle consists of a central shutter that is composed of several blades that can be moved by a spring drive and, when an opening process is triggered, release and subsequently close the opening from the center. The shutter consists, in principle, of a tubular, flexible collar of rubber or plastic fabrics that centrally opens and closes similar to an iris diaphragm when it is turned by 180°. The passage can be released and closed within seconds, namely without having to push or screw a cone, a wedge or a plate into the opening. The valve body and the rotatable part are completely shielded from the passing free-flowing material by the shutter collar. This reduces the mechanical stress to a minimum, wherein jamming or seizing is simultaneously prevented and an absolutely tight seal relative to the workspace is ensured. In addition, it is possible to prevent material losses, soiled systems and dust emissions. This shutter is suitable for large-volume receptacles that are filled with viscous mediums from the coarsest to the finest product flow, wherein this shutter is also suitable for controlling the ventilation during the filling process. This construction of the shutter makes it possible to eliminate the need for another shutter, wherein the shutter is directly attached onto the opening of the large-volume receptacle. Depending on the shutter adjustment, the opening can be opened to the required degree such that the large-volume receptacle can be emptied while being suspended, e.g., the means of a cruciform load carrying element. The shutter can be selectively actuated by means of a hand crank, an electric motor, hydraulically by means of hydraulic oil or pneumatically by means of compressed air. In case of an electric actuation, an electric gear motor with a special transmission and an overload protection in the form of a slip clutch is arranged on the shutter in order to allow a rough and fine adjustment of the material flow. This electric gear motor can be operated by means of a switching device arranged in a switch box on the shutter. In case of a pneumatic actuation, laterally flanged double-action compressed air cylinders are utilized, wherein said compressed air cylinders provide a dampening effect and contain a piston rod on one side. In this case, the power is transmitted, for example, with the aid of a plastic-coated steel cable that is guided over plastic rollers.

In addition, the shutter system may be provided with a suitable holding arrangement, e.g., chains, cables, bands, textile bands or a similar harness that is directly suspended underneath the large-volume receptacle and/or can be fixed to its holding/carrying straps. In this case, the flexible outlet connector can be pulled through the shutter system and thusly utilized without requiring any other systems.

Since the components required for the shutter are provided at least twice and arranged on top of one another, a multiple-action shutter can be realized if a suitable drive is provided. This multiple-action shutter is characterized in that the shutter simultaneously engages on the outlet of the large-volume receptacle in least two different planes.

Alternatively, the shutter may also be realized in the form of a ball valve, in which case the sealing or shutter member consists of a ball with a cylindrical bore. The shutter may also be realized in the form of a stricture valve that consists of an inflatable rubber collar arranged in the opening in the base plate of the shutter mechanism. Alternatively, a pipe segment with a rubber hose situated therein may be arranged in the opening, wherein the rubber hose can be constricted under the influence of external pressure and consequently closed. The rubber hose can be widened and opened by lowering the external pressure. The shutter may also be realized in the form of a slide, a rotary slide or a flap, wherein the slide selectively consists of a parallel slide gate valve, a disk-type slide valve, a tapered slide valve, a double-gate parallel slide valve, a double-gate tapered slide valve, a round slide valve, an oval slide valve or a flat slide valve that is actuated by subjecting the slide realized in the form of a plate to pressure. It would also be conceivable to realize the shutter in the form of a membrane-type shutoff valve or a drop-type valve with a drop-shaped sealing or shutter member.

According to an eighth embodiment, the outlet connector of the large-volume receptacle is realized in such a way that liquid products can also be filled into and removed from the large-volume receptacle, wherein it is also possible to shut off the outlet connectors of receptacles filled with liquid products by means of the shutter according to the invention. For this purpose, a coating consisting of a closed-pore soft material, e.g., sponge rubber or the like, is situated on the inner side of the outlet connector. Alternatively, the entire outlet connector may consist of a closed-pore soft material such that the shutter can be compressed by tightening a loop around the shutter, namely to such a degree that the soft material in the interior of the connector is compressed from all sides and its elastic properties prevent any liquids or solids from passing through. The inner side of the outlet connector may be additionally provided with an acid-resistant and temperature-resistant layer that is arranged on the closed-pore soft material. In this case, the outlet connector has a multi-layered structure. It is also proposed that the shutter contains a collar, around which the outlet connector is placed. In this case, the collar has its largest diameter when it is placed around the connector. The elastic coating forms a sealing surface for producing a connection with an external filling connector or emptying connector or cover in the axial and coaxial direction. For example, an elastic clamping ring for holding and sealing the shutter on the large-volume receptacle is used at locations, at which the diameter is reduced.

Instead of a collar, it would also be possible to provide an annular clamp that is provided with a lever or a clamping screw such that the clamp can be tensioned or loosened by turning the clamping screw accordingly.

According to a ninth embodiment of the device for large-volume receptacles, the device consists of an auxiliary transport means in the form of a frame that is composed of four pipe segments. These pipe segments are realized in the form of hollow members such that four uprights or posts with integrated lifting devices can be screwed or inserted into the upper ends of the pipe segments and separably connected thereto, wherein the lower ends of the four pipe segments are respectively connected to stacking legs. The four pipe segments are connected to one another by transverse beams such that they form an approximately square arrangement. In this case, the pipe segments are additionally connected to one another for reinforcement purposes with braces that are arranged in a cruciform fashion, wherein the centrally arranged intersecting point is realized in the form of an opening for accommodating the shutter mechanism such that the base plate of the shutter mechanism is centrally integrated into the cruciform braces. Alternatively, the braces may also be arranged in the shape of a star, a Y or in any other shape, wherein more than two braces may also be provided. Two, three or even four trapezoidal segments are arranged on these braces, wherein said segments are arranged in a pivoted fashion and form the bottom plate. Alternatively, an arbitrary number of segments may be provided. These segments form a tilting device that is composed of plates, arms or lowerable bottoms and may also comprise cables or chains, wherein the tilting device is connected to the base plate of the shutter mechanism by means of joints or to the frame, e.g., by means of rollers. The bottom of the large-volume receptacle lies on this tilting device, i.e., the bottom of the large-volume receptacle can be tilted. The locking device is arranged on the frame outward or, depending on the design, toward the center by means of joints, hooks, deflection rollers or the like and correspondingly connected to the frame in an articulated fashion, wherein the locking device may also be connected to a lifting device that is actuated hydraulically, pneumatically or mechanically. This lifting device connects parts of the tilting device, e.g., plates and arms, to one another in order to move the plates and arms or the lowerable bottom such that the bottom of the large-volume receptacle is tilted. This causes a difference in height between the shutter and the outer side of the tilting device. This can be achieved by raising the outer sides of the bottom of the large-volume receptacle or by lowering the center point of the bottom of the large-volume receptacle, wherein the outflow of the product situated in the large-volume receptacle is promoted in either case. It is also proposed that the straps situated on the bottom of the large-volume receptacle can, depending on the respectively chosen design, be placed on the frame or on the outer edges of the plates and arms or on the lowerable bottom. This design makes it possible to shape the bottom of the large-volume receptacle which contains a shutter into a funnel such that the contents of the receptacle can be removed in their entirety. In addition, the total height is reduced by up to 40 cm, wherein this embodiment not only makes it possible to fill and empty the receptacle with bulk material, but also with liquids. As the emptying of the large-volume receptacle progresses, the lifting device causes the bottom of the large-volume receptacle to become tilted by means of a spring. The lifting device can also be actuated by means of movable cutouts that are arranged on the underside of the transverse beams of the frame and into which the prongs of a forklift are inserted. The connection with the tilting device can be realized hydraulically, pneumatically or mechanically with the aid of cables, rods, chains or bands. The cutouts are displaced by changing the spacing between the prongs of the forklift such that the tilting device and the bottom of the large-volume receptacle are tilted to the corresponding degree. In an alternative embodiment with a lowerable bottom, the centrally installed shutter that opens or closes the outlet connector of the large-volume receptacle can be opened or closed by means of a hydraulic coupling between the cutouts in order to adjust the tilting device depending on the change in the spacing between the cutouts. For this purpose, the undersides of the transverse braces are realized in the form of rails, in which the cutouts that are either realized over part of the surface in the form of hooks or eyelets or over the entire surface in the form of box-shaped hollow members with one or more rollers on their upper sides are able to slide along such that the cutouts can be displaced.

According to a tenth embodiment of the emptying device, the tilting device is replaced with a bottom plate that is realized in the form of a rocker and contains an integral shutter mechanism, wherein the rocker is actuated via a laterally coupled rod. Hinged plates that can be pivoted upward are also arranged on the rocker to both sides of the shutter mechanism, wherein said hinged plates deform the bottom of the large-volume receptacle into the shape of a wedge during the emptying process, and wherein the hinged plates are pressed down onto the rocker by the filled large-volume receptacle. The flexing effect of the rocker simultaneously affects the bulk material in the receptacle such that a flawless emptying process is always ensured. For example, an agglomeration or the formation of a bulk material bridge are, among other things, prevented such that the pourability of the bulk material is promoted.

The rocker is connected to a rod and is driven via a cam, a hydraulic or pneumatic cylinder and a piston that is arranged in the cylinder, wherein the rocker carries out the required rocking motion in order to permanently alter the slope of the bulk material.

The filling of the large-volume receptacle can also be promoted with the rocker because the flexing effect generated by the rocker causes the material already situated in the receptacle to be uniformly distributed.

BRIEF DESCRIPTION OF THE FIGURES

A few embodiments of the invention are described in greater detail below with reference to the figures.

DETAILED DESCRIPTION OF THE PRESENT INVENTION

Figure 1:
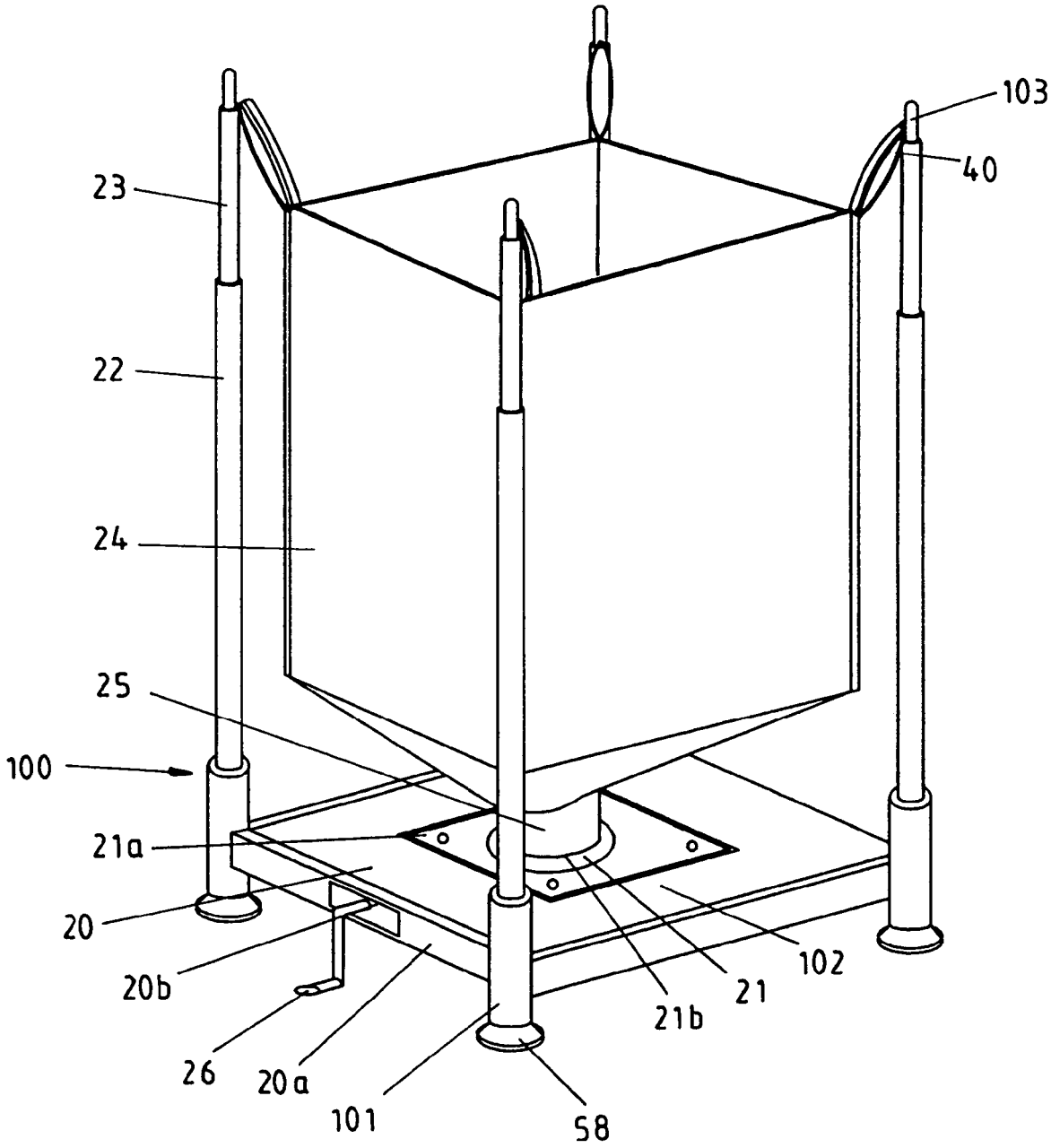
FIG. 1 shows an aspect of the device for large-volume receptacles with a metering and shutter system.

FIG. 1 shows an aspect of the device 100 for large-volume receptacles 24 which consists of an auxiliary transport means 101 in the form of a frame that is composed of at least four uprights 22. On their lower ends, these uprights are respectively provided with a stacking leg 58, wherein the uprights are connected to one another by means of batten-like transverse braces 20 *a* in order to receive a bottom plate 20 that may also be realized in the form of a palette. This bottom plate contains a central opening 21 *b* for accommodating the shutter mechanism 102 consisting of a shutter 21 that is arranged on or in the base plate 21 *a* and connected to the bottom plate 20 of the auxiliary transport means 101. The outlet connector 25 of the large-volume receptacle 24 that can be suspended in the emptying device 100 is inserted into the shutter 21, wherein the shutter 21 is separably connected to the outlet connector 25 of the large-volume receptacle 24. The uprights 22 of the auxiliary transport means 101 are realized in the form of hollow members such that a lifting mechanism 23 can be respectively integrated into their upper ends. Alternatively, the lifting mechanism that consists of not-shown gas pressure springs may also be attached to the uprights. The respective lifting devices 23 are provided with a self-tightening carrying strap holder 103 that serves for connecting the straps 40 of the large-volume receptacle 24 to the lifting mechanisms 23.

An opening 20 *b* for receiving a hand crank 26 is laterally arranged in one of the transverse braces 20 *a* in order to actuate the shutter 21, through which the outlet connector 25 of the large-volume receptacle 24 extends.

Figure 2:
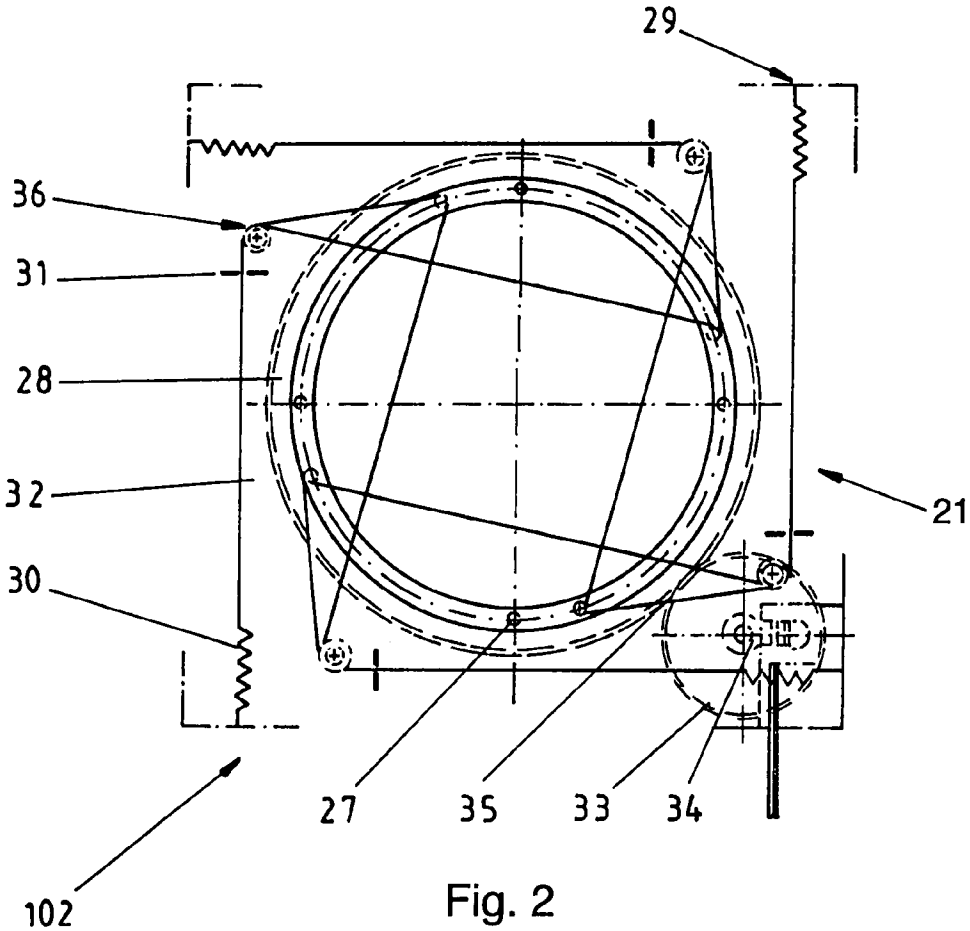
FIG. 2 shows an aspect of the metering and shutter mechanism.

FIG. 2 shows a schematic representation of the shutter mechanism 102 consisting of the shutter 21 that is arranged in the not-shown base plate and constructed in such a way that at least two cables 35, bands or chains are placed around the outlet connector of the large-volume receptacle which also consists of a flexible material and usually is centrally arranged on the receptacle underside, namely such that they are able to continuously reduce or enlarge the diameter of the outlet connector. For this purpose, the shutter 21 contains two cables 35, the ends 27 of which are symmetrically and oppositely arranged on a rotatable ring 28 in a freely movable fashion. FIG. 2 shows a variation with four cables. The opposite end 29 of the cables 35 is realized in such a way that the respective cables can be shortened and lengthened. This may, for example, be realized directly by utilizing suitable tension mechanisms, e.g., a tension spring 30 or a pneumatic tension spring. However, this may also be realized indirectly by means of pressure, gas pressure springs or the like if correspondingly designed pressure mechanisms are provided. Instead of the shown combination of a cable and a tension spring, it would, for example, also be possible to utilize a rubber band of limited expansion or the like. A stopping device 31 is incorporated into the cable construction in order to prevent the tension mechanism from being overstretched and to tighten the corresponding cable 35. The rotatable ring 28 is realized in such a way that it can be driven directly or indirectly via a suitable drive. In case of a direct drive, this is realized with the suitable toothing 32 that is arranged on the ring 28 and meshes with the drive tooting of another toothed wheel 33. Instead of utilizing the toothed wheel, the drive may also be realized with the aid of a cable, a band, a chain block or a belt. The above-mentioned drive options or the toothed wheel 33 shown are respectively moved by means of a selflocking or non-selflocking worm gear 34. The worm gear 34 is driven manually, electrically, hydraulically or pneumatically, wherein the corresponding drive unit in the form of a motor or the like is arranged on the shutter 21. In case of a direct drive, the toothing 32 arranged on the outside diameter of the rotatable ring 28 allows the direct drive via a selflocking worm gear that directly engages into the toothing of the rotatable ring and is coupled with manual drives, in particular, electric or pneumatic drives. In the embodiment according to FIG. 1, a manual drive in the form of a hand crank is used.

The guidance of the respective cables 35 is realized in such a way they do not move in one plane and consequently do not impair one another when the shutter 21 is closed. This is realized by arranging the respective mounting points of the cable ends 27 and 29 of each cable 35 at a different height. The roller 36 is used for guiding, aligning and unwinding the cables 35. Another not-shown stationary or floating ring provided between the rotatable ring and the housing closes the mechanism situated in the housing toward the outside and contains bores, through which the respectively provided number of cables are guided. Alternatively, the cables 35 may also be guided through correspondingly arranged channels, hoses or pipes of rubber, plastic or metal.

The function of the shutter 21 can be ascertained by observing the continuous and double broken line of the cables 35 in FIG. 2. The opening formed by the arrangement of the cables is continuously reduced in size due to a clockwise rotation by the corresponding angle, wherein a rotation by an angle of 70° is shown in the figure. This causes the outlet connector of a large-volume receptacle which consists of a textile material to be successively constricted until the cables are tightly placed around the connector and the outlet opening is completely shut. Since a selflocking worm gear 34 is provided, a separate locking mechanism for all opening diameters is not required. This means that it is also possible to utilize the shutter without the auxiliary transport means of the emptying device, i.e., to utilize the shutter separately for emptying bags or a similar large-volume receptacles, wherein the shutter is placed onto the open end and the open end is pulled through the shutter and locked therein. For this purpose, the shutter is provided with a corresponding suspension harness. The emptying then takes place by turning the large-volume receptacle or the bag overhead such that a metered emptying of the large-volume receptacle, e.g., a burlap sack, can be achieved with the aid of the shutter.

Figure 3:
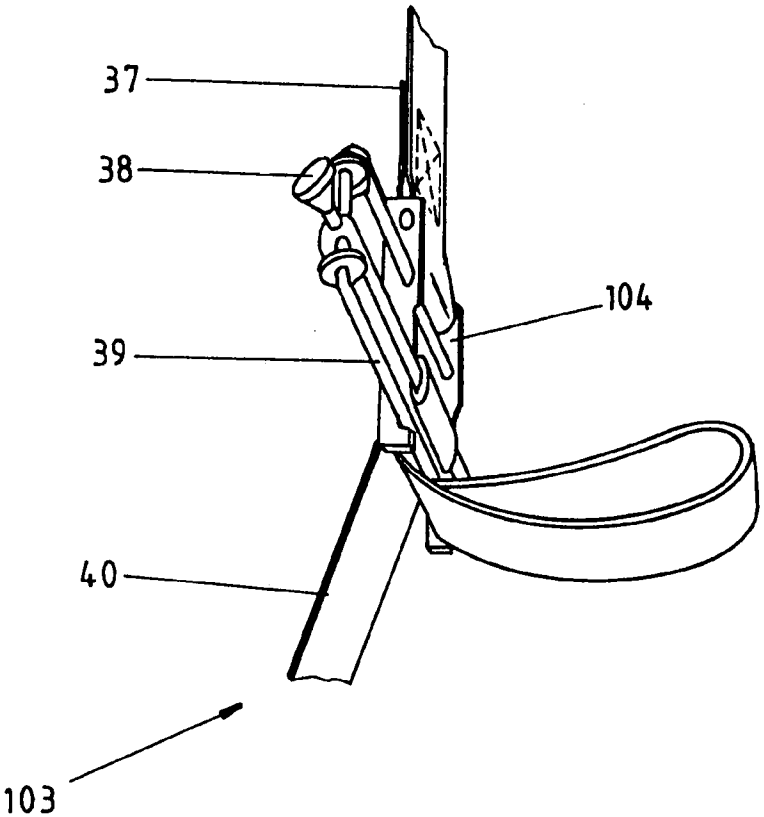
FIG. 3 shows an aspect of the self-tightening carrying strap holder.

FIG. 3 shows one variation of the carrying strap receptacle 103 that, when loading a filled large-volume receptacle into the device for large-volume receptacles, makes it possible to accommodate the respective carrying straps of the large-volume receptacle, namely a direct accommodation of the respective straps in order to suspend a filled large-volume receptacle in the not-shown device for large-volume receptacles. The carrying straps of the large-volume receptacle 40 are placed into the self-tightening carrying strap holder 104 after the rotatable bolt 38 that can also be freely moved upward and downward has been pivoted upward, i.e., out of the holding region of the holder. The carrying strap 40 that is folded into a loop is pushed through the opening of the holder, and the bolt 38 is subsequently pivoted inward and then pushed into the limit stop 39. The bolt 38 tightly adjoins the lower limit stop 39 of the holder when pulling on the thusly formed loop. This causes the end of the carrying strap which is connected to the large-volume receptacle to be tightened. The upper end of the self-tightening carrying strap holder 104 is suitably fixed on a lifting tool, e.g., a cruciform load carrying element for transporting the large-volume receptacle into the emptying device. The carrying strap 40 is automatically secured in the self-tightening carrying strap holder 104 due to the forces acting in both directions, i.e., the weight of the large-volume receptacle which represents a downwardly acting force and the force of the lifting tool 37 which represents an upwardly acting force. The free end of the carrying strap 40 can be hooked into or onto the carrying strap receptacle 103, and the filled large-volume receptacle can be lowered into the emptying device. The bolt 38 is laterally pulled out in order to disengage the tensioned connection between the carrying strap 40 of the large-volume receptacle and the lifting device. The tensioned carrying strap 40 is then abruptly alleviated from the load, and the self-tightening carrying strap holder 104 is released.

Figure 4:
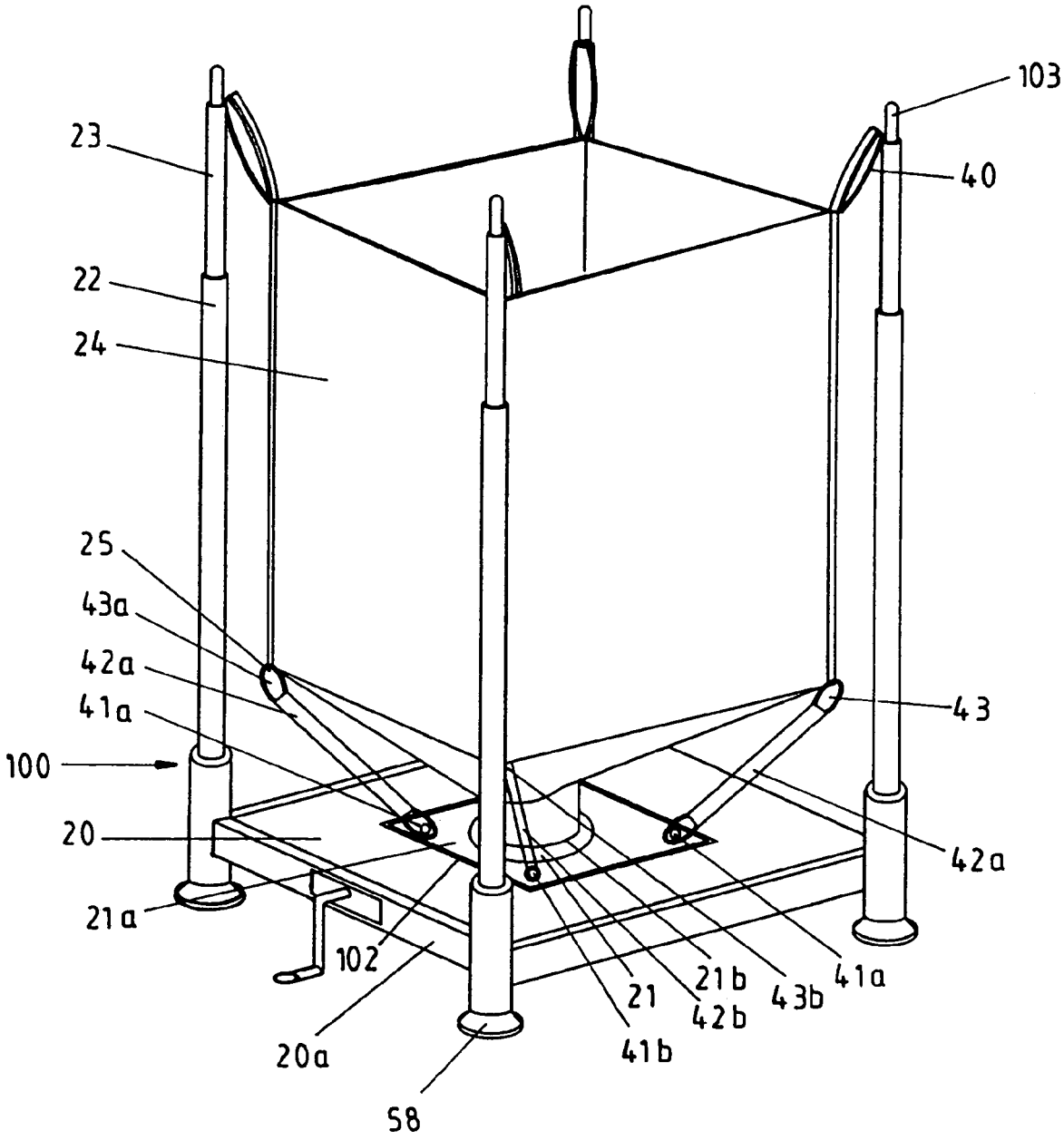
FIG. 4 shows an aspect of the device for large-volume receptacles with articulated arms arranged on the base plate of the shutter system.

FIG. 4 shows another embodiment of the device for large-volume receptacles 100 which consists of auxiliary transport means 101 in the form of a frame that is composed of four uprights 22, the lower ends of which are respectively provided with stacking legs 58. These uprights are connected to one another by means of box-shaped transverse braces 20 *a*. This frame serves for receiving a bottom plate 20 with a central opening 21 *b* for accommodating the shutter mechanism 102 consisting of a base plate 21 *a* and the shutter 21. Lifting mechanisms 23 are respectively arranged on the upper end of each upright 22. The lifting mechanisms consist of non-tensioned pneumatic pressure springs and also comprise carrying strap receptacles 103 for accommodating the straps 40 of a filled large-volume receptacle, namely with the aid of the self-tightening carrying strap holder shown in FIG. 3.

In this embodiment, four arms are additionally provided in the lower region, wherein only the arms 42, 42 *a* and 42 *b* are shown in FIG. 4. The lower ends of these arms are respectively connected in an articulated fashion to the base plate 21 *a* of the shutter mechanism 102 by means of a joint or hinge 41, 41 *a*, 41 *b*. The upper ends of the arms are provided with suspensions 43, 43 *a*, 43 *b* that may also contain a carrying strap receptacle for suspending the straps of the large-volume receptacle. This means that the upper ends of the arms 42, 42 *a*, 42 *b* can be connected to the lower straps of the large-volume receptacle 24 such that said arms are able to promote the deformation of the bottom into a funnel when the large-volume receptacle 24 is emptied by pivoting the arms upward during the emptying process. Alternatively, the arms 42, 42 *a* and 42 *b* may also be realized in the form of telescopic arms that consist of two or more partial arms that can be telescopically pushed into one another in order to adjust the length of the arms.

The arms may have a rectangular, square, hexagonal, pentagonal, triangular, circular, cylindrical, elliptical or another polygonal cross section and be made of plastic, metal or even wood. Consequently, it is possible to simultaneously suspend and fix the large-volume receptacle at eight different points.

Figure 5:
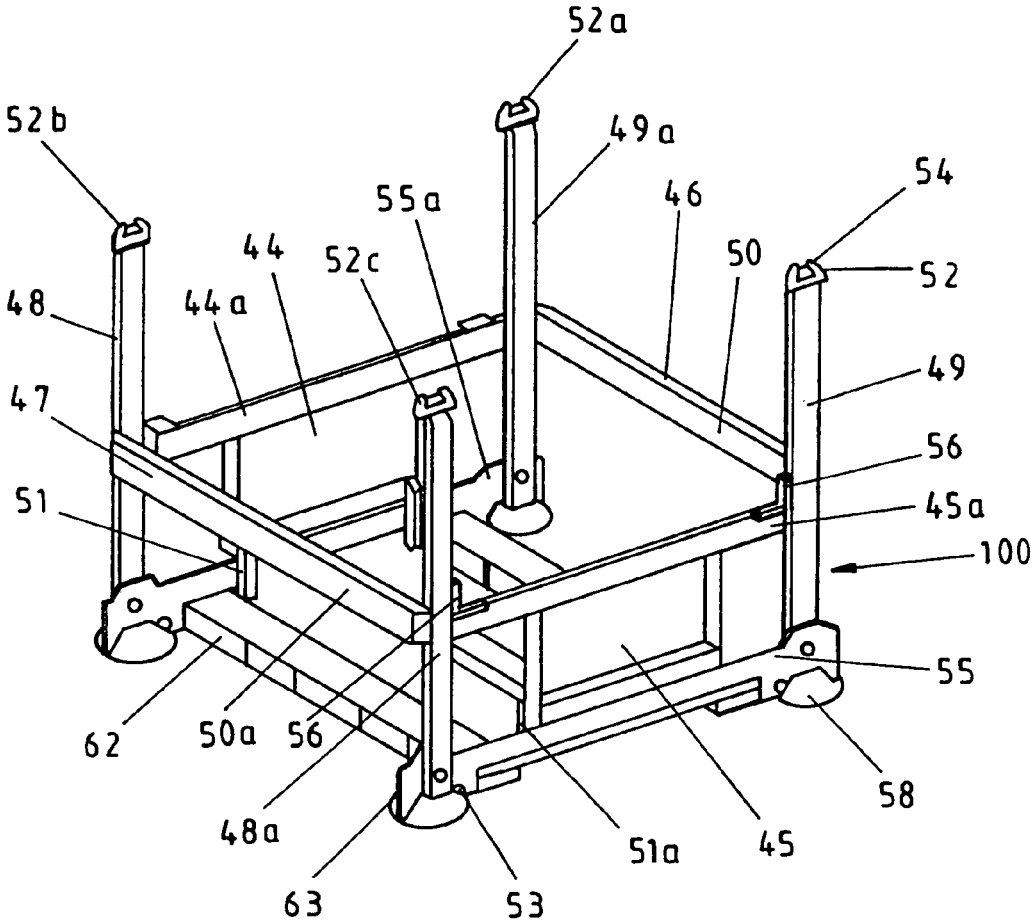
FIG. 5 shows an aspect of the auxiliary transport means of the device for large-volume receptacles which is realized in the form of a collapsible stacking palette and illustrated in the unfolded state.

FIG. 5 shows a device for large-volume receptacles 100 which consists of an auxiliary transport means in the form of a collapsible stacking palette. The auxiliary transport means realized in the form of a collapsible stacking palette consists of a frame 63 that is composed of two crossheads 55, 55 *a* that are arranged parallel to one another and may be realized in a strip-shaped or boxed-shaped fashion, wherein said crossheads are rigidly connected to at least two or more crossbeams 62 realized in the form of hollow members. Although these crossbeams usually have a box-shaped profile, they may also have a circular, elliptical or differently shaped profile, into which the prongs of the forklift can be inserted. One respective stacking leg 58 is fixed on the four outer ends of the crossheads 55, 55 *a*, wherein the lower end of said stacking legs is realized in a plate-shipped fashion with the openings pointing downward. Two hinged walls 44, 45 that can be pivoted inward such that they lie above the connecting beams 50, 50 *a* of the inner side wall 46 and the outer side wall 47 are arranged on the crossheads 55, 55 *a*, wherein said hinged walls do not lie on top of one another so as to not unnecessarily increase the structural height, and wherein the pivoting radius does not exceed half the palette width. The first and the second hinged wall 44, 45 may be selectively realized solidly or sectionally, wherein the hinged walls of a sectional variation may have a square, rectangular or any other shape, and wherein the upper ends of the hinged walls are respectively connected to one additional beam 44 *a*, 49 *a* that serves for respectively fixing the hinged walls 44, 45 on the posts 48, 48 *a* and 49, 49 *a* in a separable fashion. An inner side wall 46 with posts 49, 49 *a* and an outer side wall 47 with posts 48, 48 *a* are respectively arranged on the outer ends of the two crossheads 55, 55 *a*, wherein the posts 48, 48 *a*, as well as the posts 49, 49 *a*, are respectively connected to one another in a rigid fashion with a connecting beam 50, 50 *a* that may be selectively realized in the form of a solid member or a hollow member. If the connecting beam is realized in the form of a hollow member, it usually has a rectangular or square profile, wherein a semicircular profile would, however, also be conceivable. The inner side wall 46 and the outer side wall 47 can be pivoted inward over the first hinged wall 44 and the second hinged wall 45, wherein the posts 48, 48 *a* and 49, 49 *a* are pivoted into a plane above the connecting beams 50, 50 *a* of the side walls 46, 47 which also contains the hinged walls 44, 45 that lie above the beams 44 *a*, 45 *a* of the hinged walls 44, 45. In order to respectively attach and fix the first and the second hinged wall 44, 45 on the crossheads 55, 55 *a*, they are provided with mounting arms 51, 51 *a*, wherein the mounting arms 51, 51 *a* of the hinged walls 44 and 45 are arranged in such a way that the posts 48, 48 a and 49, 49 *a* of the inner and the outer side wall 46 and 47 are able to lie directly on the beams 44 *a*, 45 *a* of the hinged walls 44, 45, and that the mounting arms 51, 51 *a* of the posts 48, 48 *a* or 49, 49 *a* are arranged offset relative to one another such that the stacking height of the collapsed palette is smaller than or equal to the sum of the thickness of the connecting profiles 55, 55 *a* and the thickness of the post 48, 48 *a* or 49, 49 *a*. The crossheads 55, 55 a between the collapsed posts 48, 48 *a* and 49, 49 *a* respectively contain an elevation 60 on their corners in order to prevent a palette placed on top thereof from sliding. The posts 48, 48 *a* and 49, 49 *a* respectively contain suspension/stacking heads 52, 52 *a*, 52 *b* and 52 *c* on their upper ends, wherein said suspension/stacking heads can be inserted into the stacking legs of another not-shown palette in order to ensure a fast and reliable stacking of the pallets. The suspension/stacking heads 52, 52 *a*, 52 *b* and 52 *c* also serve for suspending the straps 40 of large-volume receptacles of all types. For this purpose, the suspension/stacking heads respectively contain an opening 54 that is arranged in such a way that the straps of the large-volume receptacle are not pinched or sheared off by the stacking legs of a not-shown palette placed on top thereof. This is achieved by arranging the respective openings 54 at a sufficient distance from the outer wall of the stacking head. Instead of openings 54, it would also be conceivable to provide hooks that serve for receiving the straps 40 of the large-volume receptacle. The posts 48, 48 *a* of the side wall 46 and the posts 49, 49 *a* of the side wall 47 are provided with at least one connecting element 56 for producing a connection with the hinged walls 44 and 45, as well as for separably connecting and locking the respective walls to one another. The connecting elements are able to take up and transmit in all three directions the forces occurring during the tilting process such that the palette is prevented from collapsing or unfolding. Alternatively, the suspension/stacking heads 52, 52 *a* of the side wall 46 may also be outwardly offset close to the profile in order to ensure the insertion into the stacking legs that are spaced apart from all sides by the same distance.

Figure 6:
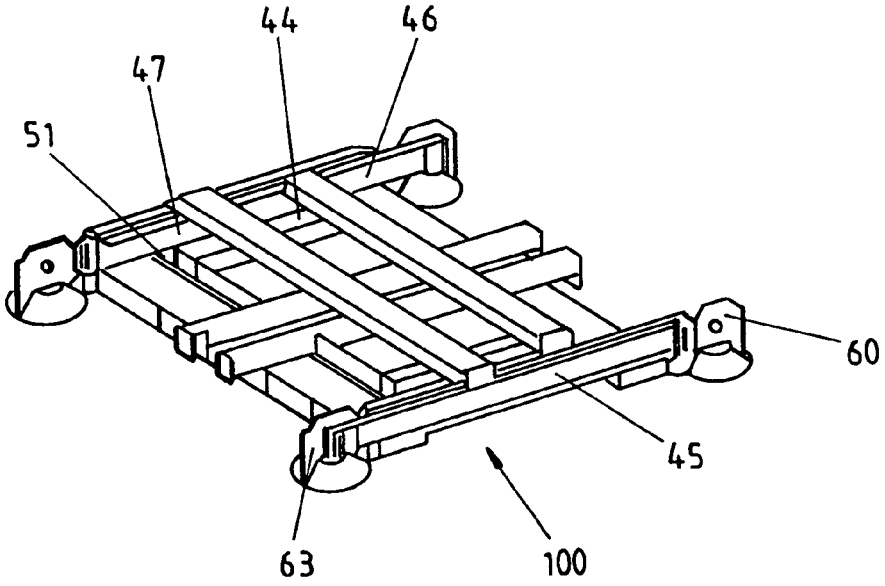
FIG. 6 shows the auxiliary transport means of an emptying device which is realized in the form of a collapsible stacking palette and illustrated in the collapsed state.

FIG. 6 shows a device for large-volume receptacles 100 which contains auxiliary transport means in the form of a collapsible stacking palette, wherein said palette is illustrated in the collapsed state. When collapsing the palette, the hinged walls 44 and 45 are initially pivoted inward, and the inner side wall 46 and the outer side wall 47 are subsequently also pivoted inward such that they lie on the hinged walls 44, 45. Due to these measures, the height of the device in the collapsed state is lower than the elevations 60 of the crossheads 55, 55 *a* which serve for receiving and stabilizing another collapsed palette placed on top thereof. The thusly collapsed frame 63 can be easily transported in a space-saving fashion, e.g., to a construction site or another location where large-volume receptacles need to be emptied.

Figure 7:
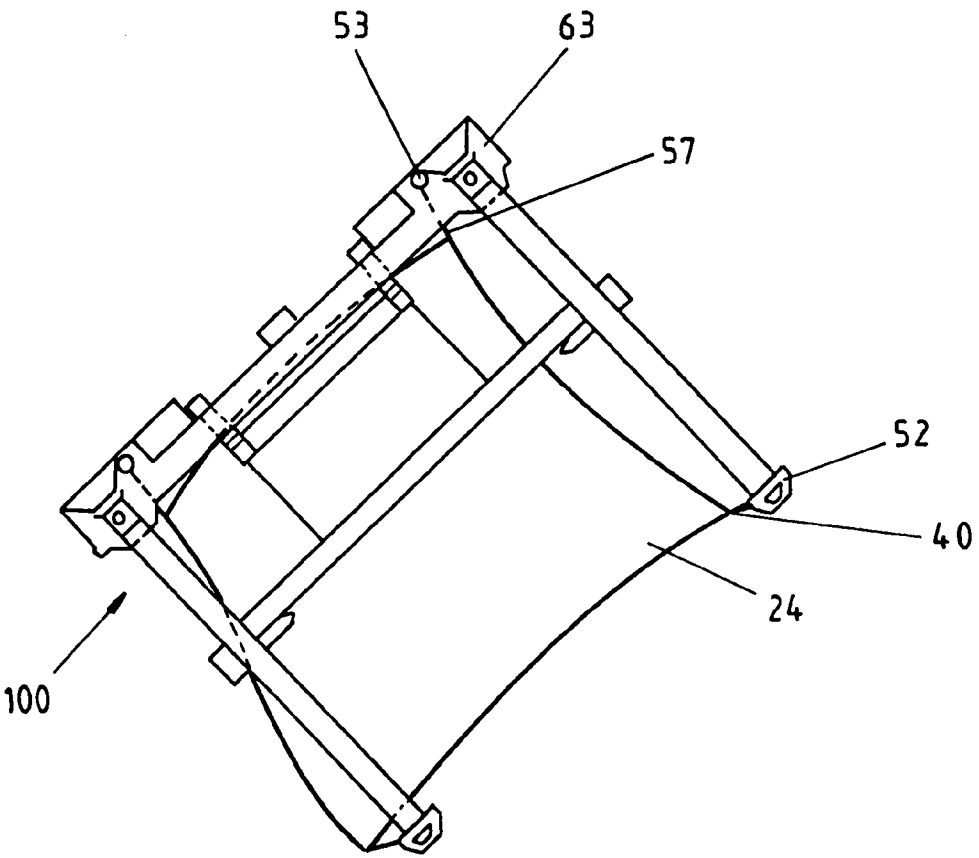
FIG. 7 shows an aspect of the device with a large-volume receptacle in the emptying position.

FIG. 7 shows a device for large-volume receptacles 100 during the emptying of a large-volume receptacle 24 that is suspended in the emptying device 100 by means of a total of eight straps 40, 57, wherein four straps are respectively arranged on the upper side and the lower side of the receptacle. The straps 40, 57 of the receptacle are fixed on the suspension/stacking heads 52, 52 *a* and on the not-shown suspension/stacking heads 52 *b* and 52 *c* such that the large-volume receptacle situated in the emptying device 100 cannot fall out when the emptying device is tilted in order to empty the receptacle. Circular cutouts 53 are additionally arranged in the crossheads 55, 55 *a* of the frame 63, wherein the lower straps of the large-volume receptacle are inserted into and fixed in said cutouts in order to achieve an additional stabilization. This means that the large-volume receptacle is fixed in position with all of its eight straps.

Figure 8:
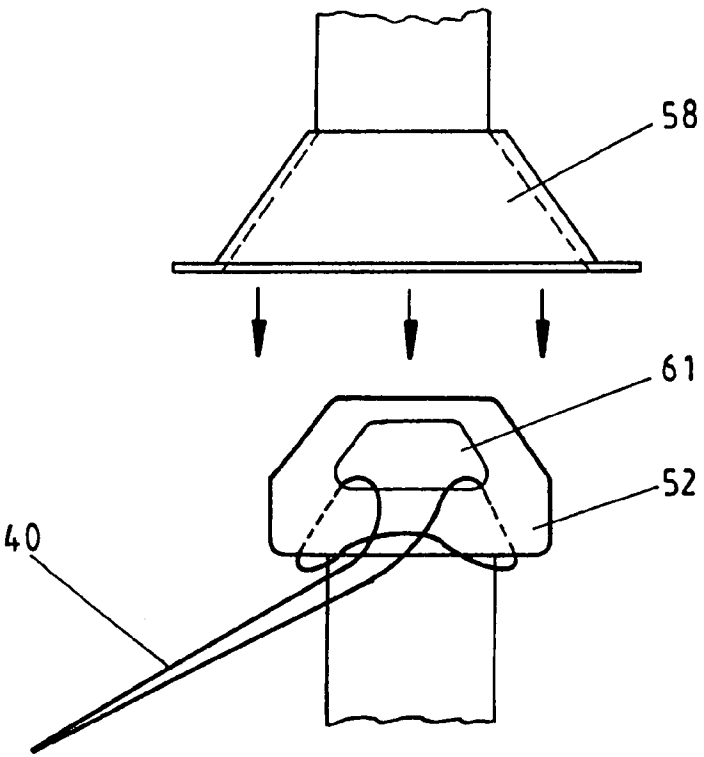
FIG. 8 shows a partial view of the upper/lower strap of the auxiliary transport means of the device for large-volume receptacles which is realized in the form of a stacking palette.

FIG. 8 shows a schematic representation of the connection between a stacking leg 58 of a first palette and a suspension/stacking head 52 of a second palette, on which the strap 40 of a not-shown large-volume receptacle is fixed. This figure indicates that the suspension/stacking head 52 is realized trapezoidally. The opening 61 may also have a trapezoidal shape, wherein this opening may, however, also have a circular, rectangular, square or elliptical shape, as well as the shape of a rod, a kidney or any other shape. In order to ensure that several palettes can be flawlessly stacked on top of one another, it is decisive that the stacking leg 58 and the suspension/stacking head 52 have the same shape because it must be possible to exactly connect the stacking leg and the suspension/stacking head in the form of positive and negative parts such that no play remains and pallets stacked on top of one another are prevented from sliding.

Figure 9:
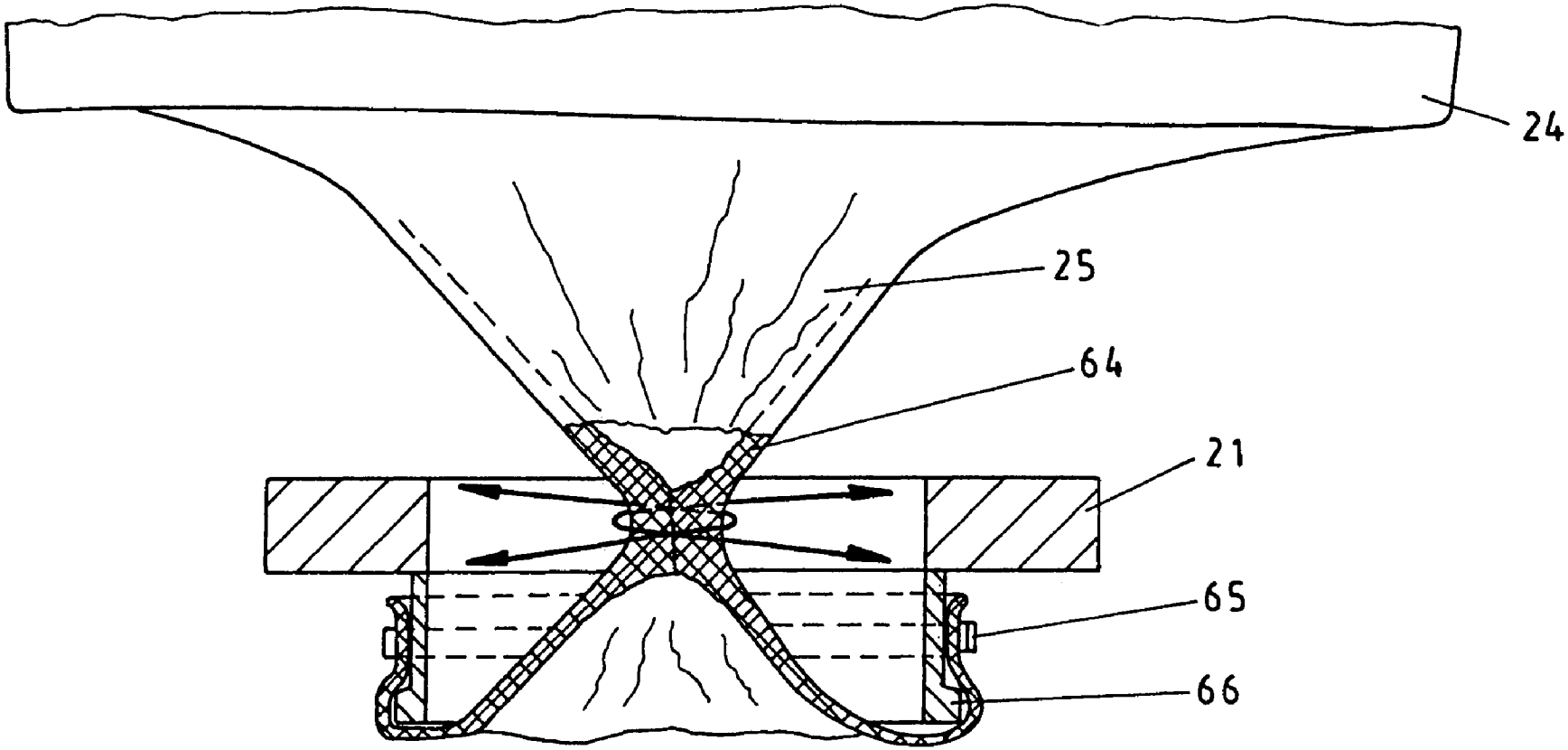
FIG. 9 shows an aspect of the design of an outlet connector for large-volume receptacles with liquid contents.

FIG. 9 shows an enlarged representation of an outlet connector 25 of a large-volume receptacle 24 that is also suitable for accommodating liquids, wherein the inner side of the outlet connector 25 is provided with a coating 64 of a closed-pore soft material. Alternatively, the entire outlet a connector 25 could also consist of a closed-pore soft material. The thusly realized outlet connector 25 can be inserted into the shutter 21 that may be additionally provided with a collar, around which the outlet connector 25 is placed. The outlet connector 25 has its largest diameter when it is placed around the collar 66. The shutter 21 is also provided with an elastic clamping ring 65 that is arranged at the location, at which the diameter of the collar 66 is reduced. The function of this clamping ring consists of holding and sealing the shutter 21 on the outlet connector 25 of the large-volume receptacle 21 after it is placed against the outside wall of the shutter 21. In this case, the shutter consists of a plate with an opening, on the underside of which a tubular or annular connection piece is arranged. The outlet connector 25 tightly adjoins the outside wall of this connection piece that serves for holding the clamping ring 65. This makes it possible to seal the outlet connector 25 on a docking surface of a docking device. For this purpose, the annular connection piece and the clamping ring may be provided with corresponding profiles that engage into one another.

This arrangement makes it possible to prevent an accidental contamination of the product situated in the receptacle with dirt particles or contaminant particles that adhere to or are situated on the outside of the receptacle.

Figure 10:
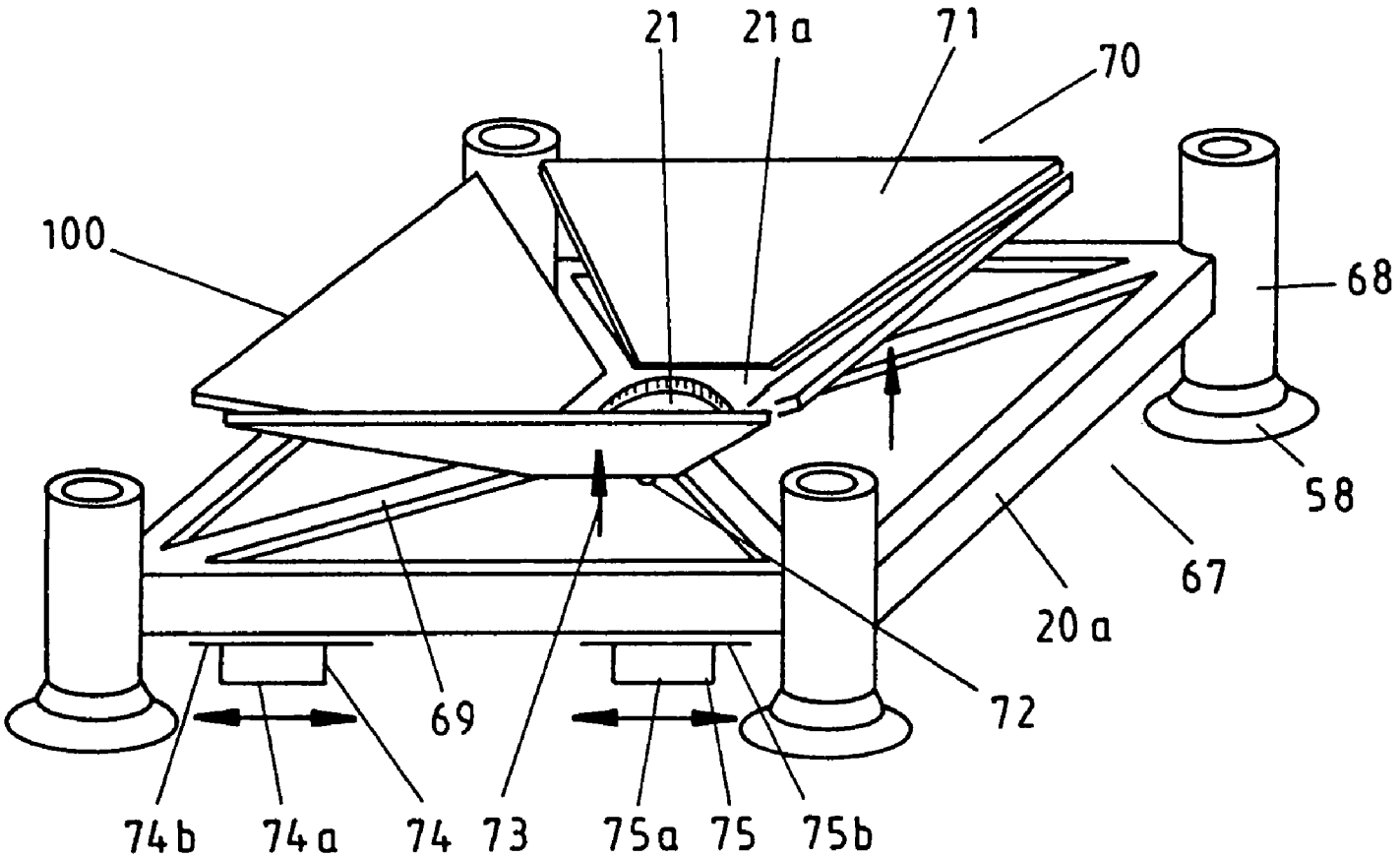
FIG. 10 shows an aspect of a device for large-volume receptacles with a tilting device.

FIG. 10 shows an aspect of a device for large-volume receptacles 100 which consists of a base 67 that is composed of four pipe segments 68 that are respectively provided with a stacking leg 58 on their underside. On their upper side, these pipe segments can be provided with not-shown uprights or posts that respectively contain an integrated lifting device in their upper region and are connected to one another by means of a transverse brace 20 *a* such that an approximately square arrangement is formed. The four pipe segments 68 are additionally connected to one another with braces 69 that are arranged in a cruciform fashion, wherein the shutter 21 is arranged in the central intersecting point of said braces. The base plate 21 *a* of the shutter 21 is integrated into the cruciformly arranged braces 69 such that one end of the braces 69 is directly connected to the base plate 21 *a* of the shutter 21. A tilting device 70 that consists of at least four trapezoidal plate segments 71 is arranged on the base plate 21 *a*. These plate segments are movably connected to the base plate (21 *a*) by means of joints 72, wherein hinges could also be utilized instead of joints. The plate segments 71 could also have a square, rectangular, rhombohedral, rhomboidal or deltoidal shape, as well as the shape of an irregular quadrangle, a polygon or even a triangular, pentagonal, hexagonal or octagonal shape. The plates are respectively connected to a lower lifting device 73 that can be actuated hydraulically, pneumatically, electrically or mechanically and connects the parts of the tilting device 70 in the form of plates and arms to one another. Due to these measures, the plates or arms or the lowerable bottom can be moved collectively such that the bottom of the large-volume receptacle is tilted.

At least two or more cutouts 74, 75 are arranged on at least one or more transverse braces 20 *a* that are realized in the form of rails with their openings pointing downward, wherein said cutouts respectively consist of a frame 74 *a*, 75 *a* that is fixed on a strip 74 *b*, 75 *b*, on the upper side of which at least one or more rollers are fixed. These rollers are able to engage into the transverse braces 20 *a* realized in the form of a rail such that the cutouts 74, 75 can be moved by the prongs of a forklift after they are inserted into the cutouts. In this case, the cutouts could also be connected to the lower lifting device 73 such that the lower lifting device 73 can also be actuated with the prongs of the forklift. This may be realized hydraulically, pneumatically or mechanically with the aid of cables, rods, chains or bands. The lower lifting device 73 may also be connected to the synchronized upper lifting device integrated into the uprights of the auxiliary transport means such that both lifting devices can be actuated collectively with the prongs of the forklift. In this case, an additional isolating switch can be provided such that only the upper or only the lower lifting device can be actuated with the prongs of the forklift depending on the respective requirements. This means that the emptying device can be actuated and operated by a single person, namely the driver of the forklift. It should also be noted that the shutter 21 could be connected to the cutouts 74, 75 such that the shutter can also be actuated by inserting and correspondingly moving the prongs of the forklift.

LIST OF REFERENCE SYMBOLS

20 Bottom plate
20 *a* Transverse braces
20 *b* Opening
21 Shutter
21 *a* Base plate
21 *b* Opening
22 Upright
23 Lifting mechanism
24 Large-volume receptacle
25 Outlet connector
26 Hand crank
27 First mounting point for cable end I
28 Rotatable ring
29 Second mounting point for cable end II
30 Tension spring
31 Stopping device
32 Toothing
33 Toothed wheel
34 Worm gear
35 Cable
36 Roller
37 Connection with the lifting tool
38 Retractable and rotatable bolt
39 Limit stop
40 Carrying strap of the large-volume receptacle
41 *a* Joint
41 *b* Joint
41 *c* Joint
42 *a* Arm
42 *b* Arm
42 *c* Arm
43 *a* Suspension
43 *b* Suspension
43 *c* Suspension
44 First hinged wall
44 *a* Beam
45 Second hinged wall
45 *a* Beam
46 Inner side wall
47 Outer side wall
48 Post
48 *a* Post
49 Post
49 *a* Post
50 Connecting beam
51 Mounting arm
52 Suspension/stacking head
52 *a* Suspension/stacking head
52 *b* Suspension/stacking head
52 *c* Suspension/stacking head
53 Circular cutout
54 Opening
55 Crosshead
55 *a* Crosshead
56 Connecting element
57 Strap
58 Stacking leg
59 Large-volume receptacle
60 Elevation
61 Openings
62 Beam
63 Frame
64 Coating
65 Clamping ring
66 Collar
67 Base
68 Pipe segment
69 Brace
70 Tilting device
71 Plate segment
72 Joint
73 Lower lifting device
74 Cutout
74 *a* Frame
74 *b* Strip
75 Cutout
75 *a* Frame
75 *b* Strip
100 Device
101 Auxiliary transport means
102 Shutter mechanism
103 Carrying strap receptacle
104 Self-tightening carrying strap holder

The invention claimed is:

1. A device for large-volume receptacles which serves for accommodating, transporting, storing and emptying in a controlled fashion pourable products situated in flexible large-volume receptacles, the device for large-volume receptacles comprising:

an auxiliary transport means for accommodating a large-volume receptacle; and a shutter mechanism for emptying the large-volume receptacle in a metered fashion;

wherein the auxiliary transport means has a plurality of uprights formed as hollow members and a lifting mechanism arranged in an upper end of each of the uprights, and a stacking leg arranged on a lower end of each of the uprights.

2. The device for large-volume receptacles according to claim 1, wherein the uprights are connected to one another in their lower region by means of transverse braces and form a frame for accommodating a bottom plate, wherein the bottom plate is provided with a centrally arranged opening for accommodating the shutter system.

3. The device for large-volume receptacles according to claim 2, wherein the shutter mechanism is arranged in the central opening of the bottom plate, wherein the shutter mechanism includes a shutter that is arranged in a base plate that is fixed on the bottom plate.

4. The device for large-volume receptacles according to claim 2, wherein the bottom plate is formed as a palette.

5. The device for large-volume receptacles according to claim 2, wherein an attachment in the form of a frame can be fixed on the bottom plate such that the device can be utilized with all types of large-volume receptacles, including container-like large-volume receptacles.

6. The device for large-volume receptacles according to claim 1, wherein the shutter includes at least two cables, one end of each cable being symmetrically and oppositely arranged on a rotatable driven ring in a freely movable fashion such that the cables are concentrically placed around an outlet connector of the large-volume receptacle which outlet connector is formed from a flexible material, such that the cables continuously and concentrically reduce or enlarge a diameter of the outlet connector in order to control the emptying of the product situated in the large-volume receptacle.

7. The device for large-volume receptacles according to claim 6, wherein the shutter is provided with suitable holding systems such that the shutter can be suspended underneath the large-volume receptacle, and wherein the outlet connector of the large-volume receptacle can be pulled through the shutter, such that the shutter can be directly utilized without requiring any other systems.

8. The device for large-volume receptacles according to claim 6, wherein the device is provided with four arms that are movably fixed on a base plate of the shutter mechanism by means of a joint and the four arms each contain a suspension on their other ends, wherein the suspensions of the arms are arranged a plurality of carrying straps situated in a lower region of the large volume receptacle in order to promote the formation of a funnel during the emptying of the large-volume receptacle.

9. The device for large-volume receptacles according to claim 1, wherein a plurality of carrying straps of the large-volume receptacle can each be respectively suspended in a self-tightening carrying strap holder, the self-tightening carrying strap holder including a retractable and rotatable bolt; and wherein the carrying straps of the large-volume receptacle can be folded into loops and the self-tightening carrying strap holders can be fixed on the lower ends of the carrying straps when placing a filled large-volume receptacle into the device such that a connection with a transport and lifting means is produced and the load is suspended, and wherein the upper segment or loop is freely movable and can be used for producing the connection with the lifting mechanism.

10. The device for large-volume receptacles according to claim 1, wherein the auxiliary transport means includes a collapsible stacking palette, in which a first and a second hinged wall can be pivoted inward and placed above a connecting beam such that they do not lie on top of one another wherein the pivoting radius of each hinged wall does not exceed half the palette width, and an inner side wall with posts arranged thereon and an outer side wall with posts arranged thereon can be pivoted inward on top of the hinged walls, and wherein the posts of the inner and outer side walls can be pivoted into the same plane above the connecting beam.

11. The device for large-volume receptacles according to claim 10, wherein the first and second hinged walls are respectively provided with at least one connecting element for producing a connection with the posts of the inner side wall and with the posts of the outer side wall, and wherein said connecting elements distribute occurring forces such that the palette is prevented from collapsing or unfolding.

12. The device for large-volume receptacles according to claim 11, wherein the inner and outer sidewalls are commonly connected to at least two crossheads, the inner and outer sidewall posts are respectively provided with suspension/stacking heads on their upper ends, and wherein the suspension/stacking heads of the inner side wall posts are arranged such that they are outwardly offset on the crossheads and the suspension/stacking heads of the outer side wall are arranged such that they are inwardly offset lose to the crossheads.

13. The device for large-volume receptacles according to claim 12, wherein the posts are respectively provided with a stacking leg on their lower ends, wherein said stacking legs can be inserted into the suspension/stacking heads of a second device for large-volume receptacles realized in the form of a collapsible stacking palette.

14. The device for large-volume receptacles according to claim 12, wherein the crossheads are connected to one another by at least two crossbeams realized in the form of hollow members, wherein the sides of the crossbeams contain openings such that prongs of a forklift can engage the crossbeams, and wherein the forklift is able to raise the device for large-volume receptacles and empty the large-volume receptacle situated therein in the form of a tilting motion.

15. The device for large-volume receptacles according to claim 1, wherein a cover with a centrally arranged opening can be fixed on the uprights in order to cover an upper opening of the large-volume receptacle, and wherein the large-volume receptacle can be emptied and ventilated by means of a line and filled in a metered fashion with the aid of the shutter mechanism.

16. The device for large-volume receptacles according to claim 1, wherein an inner side of an outlet connector of the large-volume receptacle is provided with a coating of a closed-pore soft material.

17. The device for large-volume receptacles according to claim 1, wherein the shutter is provided with a collar, around which collar an outlet connector can be placed, and the shutter is designed in such a way that the outlet connector can be fixed on the shutter with a clamping ring.

18. The device for large-volume receptacles according to claim 1, wherein the auxiliary transport means includes a base that is composed of pipe segments that are respectively connected to one another by means of both transverse and cruciformly arranged braces, and wherein one stacking leg is arranged on the lower side of each pipe segment and one upright can be inserted into and fixed in the upper side of each pipe segments.

19. The device for large-volume receptacles according to claim 18, wherein an intersecting point of the cruciformly arranged braces forms a base plate for accommodating the shutter, wherein a tilting device provided with at least four plate segments is arranged on said base plate, and wherein-said plate segments are movably connected to the base plate by means of joints.

20. The device for large-volume receptacles according to claim 19, wherein the plate segments of the tilting device can be connected to a lower lifting device that can be connected to the lifting mechanism arranged in the uprights.

21. The device for large-volume receptacles according to claim 20, wherein the transverse braces are realized in the form of rails and are provided with at least two cutouts composed of a frame and a strip arranged thereon, wherein the upper side of the cutouts are provided with rollers that engage the transverse braces such that prongs of a forklift, inserted into the cutouts can move the cutouts relative to the transverse braces and by means of such relative motion actuate the tilting device, the lower lifting device and/or the lifting mechanism and/or the shutter.

* * * * *

UNITED STATES PATENT AND TRADEMARK OFFICE

CERTIFICATE OF CORRECTION

PATENT NO. : 7,140,516 B2
APPLICATION NO. : 10/250540
DATED : November 28, 2006
INVENTOR(S) : Kerim Patrick Bother et al.

It is certified that error appears in the above-identified patent and that said Letters Patent is hereby corrected as shown below:

Column 25, Line 54 in claim 8, please delete the number “6” and replace it with the number --7--.
Column 26, Line 37 in claim 12, please delete the word “lose” and replace it with the word --close--.

Signed and Sealed this

Thirteenth Day of March, 2007

JON W. DUDAS
*Director of the United States Patent and Trademark Office*